US009625838B2

(12) United States Patent
Sugiyama et al.

(10) Patent No.: US 9,625,838 B2
(45) Date of Patent: Apr. 18, 2017

(54) ELECTROPHOTOGRAPHIC APPARATUS, PROCESS CARTRIDGE, AND IMAGE FORMING METHOD

(71) Applicant: CANON KABUSHIKI KAISHA, Tokyo (JP)

(72) Inventors: Kazumichi Sugiyama, Numazu (JP); Daisuke Tanaka, Yokohama (JP); Takeshi Murakami, Numazu (JP); Daisuke Kawaguchi, Toride (JP); Kazuhiro Yamauchi, Suntou-gun (JP); Satoru Nishioka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/949,257

(22) Filed: Nov. 23, 2015

(65) Prior Publication Data

US 2016/0154324 A1 Jun. 2, 2016

(30) Foreign Application Priority Data

Nov. 28, 2014 (JP) ..... 2014-242579

(51) Int. Cl.
*G03G 5/04* (2006.01)

(52) U.S. Cl.
CPC ..... *G03G 5/04* (2013.01)

(58) Field of Classification Search
CPC ..... G03G 5/04; G03G 5/144; G03G 5/142; G03G 15/00
See application file for complete search history.

(56) References Cited

U.S. PATENT DOCUMENTS 4,734,735 A 3/1988 Haneda
5,087,517 A 2/1992 Sagawa
(Continued)

FOREIGN PATENT DOCUMENTS

JP H05210300 A 8/1993
JP H10207186 A 8/1998
(Continued)

OTHER PUBLICATIONS

U.S. Appl. No. 14/949,604, filed Nov. 23, 2015, first named inventor Daisuke Kawaguchi.
(Continued)

*Primary Examiner* — Clayton E LaBelle
*Assistant Examiner* — Ruifeng Pu
(74) *Attorney, Agent, or Firm* — Canon U.S.A. Inc., IP Division

(57) ABSTRACT

An electrophotographic apparatus includes a cylindrical electrophotographic photosensitive member, a charging roller that is disposed in contact with the electrophotographic photosensitive member and applies a direct current voltage to charge the electrophotographic photosensitive member, and a driving force transmission that transmits a driving force which causes rotation so that contact portions of the electrophotographic photosensitive member and the charging roller move in the same direction and the peripheral speed of the charging roller is higher than the peripheral speed of the electrophotographic photosensitive member, wherein the undercoat layer of the electrophotographic photosensitive member contains metal oxide and the undercoat layer has a volume resistivity of $1\times10^{7}$ Ω·cm or more and $1\times10^{14}$ Ω·cm or less.

16 Claims, 4 Drawing Sheets

(56) References Cited

U.S. PATENT DOCUMENTS

| | | | | |
|---|---|---|---|---|
| 5,349,426 | A | 9/1994 | Kudoh | |
| 5,355,390 | A | 10/1994 | Yamamoto | |
| 5,517,289 | A * | 5/1996 | Ito | G03G 15/0216 399/149 |
| 5,660,961 | A | 8/1997 | Yu | |
| 5,670,284 | A | 9/1997 | Kishi | |
| 7,556,903 | B2 | 7/2009 | Yanagawa | |
| 2001/0044063 | A1 | 11/2001 | Hamaguchi | |
| 2003/0113645 | A1 | 6/2003 | Suzuki | |
| 2003/0175605 | A1 | 9/2003 | Katayama | |
| 2003/0228172 | A1 | 12/2003 | Nakamura | |
| 2004/0043315 | A1 * | 3/2004 | Takiguchi | G03G 9/0819 430/108.6 |
| 2004/0214100 | A1 | 10/2004 | Yu | |
| 2005/0069797 | A1 | 3/2005 | Niimi | |
| 2005/0100806 | A1 | 5/2005 | Hongo | |
| 2006/0008719 | A1 | 1/2006 | Niimi | |
| 2006/0240346 | A1 | 10/2006 | Toda | |
| 2008/0124641 | A1 | 5/2008 | Toriyama | |
| 2009/0010664 | A1 | 1/2009 | Nukada | |
| 2009/0060574 | A1 | 3/2009 | Shibata | |
| 2009/0142093 | A1 | 6/2009 | Sawada | |
| 2009/0311011 | A1 | 12/2009 | Hayase | |
| 2010/0021835 | A1 | 1/2010 | Akiyama | |
| 2011/0020739 | A1 | 1/2011 | Nakamura | |
| 2011/0269062 | A1 * | 11/2011 | Tong | G03G 5/0614 430/57.2 |
| 2011/0269063 | A1 * | 11/2011 | Wu | G03G 5/0614 430/58.8 |
| 2012/0008984 | A1 | 1/2012 | Kami | |
| 2012/0034556 | A1 | 2/2012 | Nebashi | |
| 2012/0051786 | A1 | 3/2012 | Katayama | |
| 2012/0052423 | A1 | 3/2012 | Maruyama | |
| 2012/0070188 | A1 | 3/2012 | Hirakoso | |
| 2012/0114375 | A1 * | 5/2012 | Fujii | G03G 5/144 399/111 |
| 2012/0263499 | A1 * | 10/2012 | Yamauchi | G03G 15/0233 399/176 |
| 2013/0164671 | A1 | 6/2013 | Matsui | |
| 2013/0323632 | A1 | 12/2013 | Fujii | |
| 2014/0038094 | A1 | 2/2014 | Hamaguchi | |
| 2014/0065529 | A1 * | 3/2014 | Fujii | G03G 5/104 430/56 |
| 2014/0178809 | A1 | 6/2014 | Matsusaki | |
| 2015/0205218 | A1 | 7/2015 | Tsuji | |
| 2015/0241800 | A1 | 8/2015 | Tomono | |
| 2015/0241803 | A1 * | 8/2015 | Ikari | G03G 5/14 430/56 |
| 2015/0331346 | A1 * | 11/2015 | Yamauchi | G03G 15/00 492/18 |
| 2016/0026099 | A1 * | 1/2016 | Tokimitsu | G03G 5/144 430/65 |

FOREIGN PATENT DOCUMENTS

| | | | |
|---|---|---|---|
| JP | H10312102 | A | 11/1998 |
| JP | 2002123046 | A | 4/2002 |
| JP | 2005140945 | A | 6/2005 |
| JP | 200718771 | A | 7/2007 |
| JP | 2008070518 | A | 3/2008 |
| JP | 2008299020 | A | 12/2008 |

OTHER PUBLICATIONS

U.S. Appl. No. 14/949,295, filed Nov. 23, 2015, first named inventor Daisuke Tanaka.

U.S. Appl. No. 14/949,604, filed Nov. 23, 2015, Daisuke Kawaguchi.

U.S. Appl. No. 14/949,295, filed Nov. 23, 2015, Daisuke Kawaguchi.

* cited by examiner

ELECTROPHOTOGRAPHIC APPARATUS, PROCESS CARTRIDGE, AND IMAGE FORMING METHOD

BACKGROUND OF THE INVENTION

Field of the Invention

The present invention relates to an electrophotographic apparatus, a process cartridge, and an image forming method.

Description of the Related Art

An electrophotographic apparatus that employs an electrophotographic process includes an electrophotographic photosensitive member, a charging device that charges the electrophotographic photosensitive member, a developing device that supplies a toner onto the electrophotographic photosensitive member to form a toner image, and a transfer device that transfers the toner image onto a transfer material such as a paper sheet, for example. A residual toner left on the electrophotographic photosensitive member without being transferred onto the transfer material is removed by a cleaning device (cleaning blade) from the electrophotographic photosensitive member.

In recent years, from the standpoint of size reduction of electrophotographic apparatuses, environmental preservation, and effective use of resources, a cleaner-less system that does not have a cleaning device and collects a residual toner back to the developing device has been proposed.

Japanese Patent Laid-Open No. 05-210300 discloses a technique in which a peripheral speed difference is caused between a charging roller and a cylindrical photosensitive member, so that a portion to which a residual toner adheres and a portion to which a residual toner has moved and adhered due to the peripheral speed difference are uniformly charged. Japanese Patent Laid-Open No. 2005-140945 states that a developer containing a certain amount of conductive particles relative to the weight of the toner is used; and a charging roller is brought into contact with an electrophotographic photosensitive member and is driven with a peripheral speed difference relative to the photosensitive member. It also states that, as a result, high uniformity of charging is achieved and a residual toner is collected to the developing device, so that fogging is suppressed. Japanese Patent Laid-Open No. 2002-123046 discloses a technique in which an auxiliary charging device is additionally used between the transfer step and the charging step so that uniform charging is achieved.

SUMMARY OF THE INVENTION

An embodiment of the present invention provides an electrophotographic apparatus including:

a cylindrical electrophotographic photosensitive member;

a charging roller that is disposed so as to be in contact with the electrophotographic photosensitive member and applies a direct current voltage to charge the electrophotographic photosensitive member;

a driving force transmission that transmits a driving force which causes rotation so that contact portions of the electrophotographic photosensitive member and the charging roller move in the same direction and a peripheral speed of the charging roller is higher than a peripheral speed of the electrophotographic photosensitive member; and a developing device that supplies a toner onto the electrophotographic photosensitive member to form a toner image, wherein the developing device is configured to collect a residual toner left on the electrophotographic photosensitive member after the toner image has been transferred onto a transfer material, the electrophotographic photosensitive member includes a support, an undercoat layer on the support, and a photosensitive layer on the undercoat layer, the undercoat layer contains metal oxide particles, and the undercoat layer has a volume resistivity of $1\times10^{7}$ Ω·cm or more and $1\times10^{14}$ Ω·cm or less.

Another embodiment of the present invention provides a process cartridge detachably attachable to a main body of an electrophotographic apparatus, the process cartridge including:

a cylindrical electrophotographic photosensitive member;

a charging roller that is disposed so as to be in contact with the electrophotographic photosensitive member and charges the electrophotographic photosensitive member; and a driving force transmission that transmits a driving force which causes rotation so that contact portions of the electrophotographic photosensitive member and the charging roller move in the same direction and a peripheral speed of the charging roller is higher than a peripheral speed of the electrophotographic photosensitive member, wherein the process cartridge does not include a cleaning blade, the electrophotographic photosensitive member includes a support, an undercoat layer on the support, and a photosensitive layer on the undercoat layer, the undercoat layer contains metal oxide particles, and the undercoat layer has a volume resistivity of $1\times10^{7}$ Ω·cm or more and $1\times10^{14}$ Ω·cm or less.

Another embodiment of the present invention provides an image forming method including:

a step of charging a cylindrical electrophotographic photosensitive member by applying a direct current voltage with a charging roller in contact with the electrophotographic photosensitive member;

an electrostatic latent image-forming step of forming an electrostatic latent image on the charged electrophotographic photosensitive member;

a developing step of forming a toner image on the electrophotographic photosensitive member by developing the electrostatic latent image with a toner; and a transfer step of transferring the toner image formed on the electrophotographic photosensitive member onto a transfer material via an intermediate transfer body or without using an intermediate transfer body, wherein the image forming method includes a step of transmitting a driving force which causes rotation so that contact portions of the electrophotographic photosensitive member and the charging roller move in the same direction and so as to generate a peripheral speed difference between the charging roller and the electrophotographic photosensitive member, in the developing step, a residual toner left on the electrophotographic photosensitive member is collected after the toner image has been transferred onto a transfer material, the electrophotographic photosensitive member includes a support, an undercoat layer on the support, and a photosensitive layer on the undercoat layer, the undercoat layer contains metal oxide particles, and the undercoat layer has a volume resistivity of $1\times10^{7}$ Ω·cm or more and $1\times10^{14}$ Ω·cm or less.

Further features of the present invention will become apparent from the following description of exemplary embodiments with reference to the attached drawings.

DESCRIPTION OF THE EMBODIMENTS

In order to further reduce the size of electrophotographic apparatuses, in addition to the cleaner-less system, a direct current charging system that allows simplification of the power supply device may be employed. However, unlike the alternating current charging system, use of the direct current charging system tends to cause a nonuniform surface potential of the electrophotographic photosensitive member because discharging stops after the surface potential of the electrophotographic photosensitive member reaches a certain value. For example, even in the case where a peripheral speed difference is provided between the electrophotographic photosensitive member and the charging roller in Japanese Patent Laid-Open No. 05-210300, when the surface potential reaches a certain value before a residual toner moves, discharging stops. As a result, the surface potential tends to be nonuniform between a portion where the residual toner is present and a portion where the residual toner is not present.

For Japanese Patent Laid-Open No. 2005-140945, injection charging occurs from, as starting points, conductive particles contained in the developer, which probably results in instability of dark-area potential. For the method in Japanese Patent Laid-Open No. 2002-123046, employment of the cleaner-less system involves use of the auxiliary charging device. Thus, there is room for reduction in the size of electrophotographic apparatuses.

The present invention provides, in the case of employing a cleaner-less system in which a developing device is used to collect a residual toner and employing a direct current charging system, an electrophotographic apparatus, a process cartridge, and an image forming method in which the capability of collecting a residual toner and the capability of performing uniform charging are provided at high levels.

An electrophotographic apparatus and a process cartridge according to embodiments of the present invention will be described below with reference to drawings.

Figure 1:
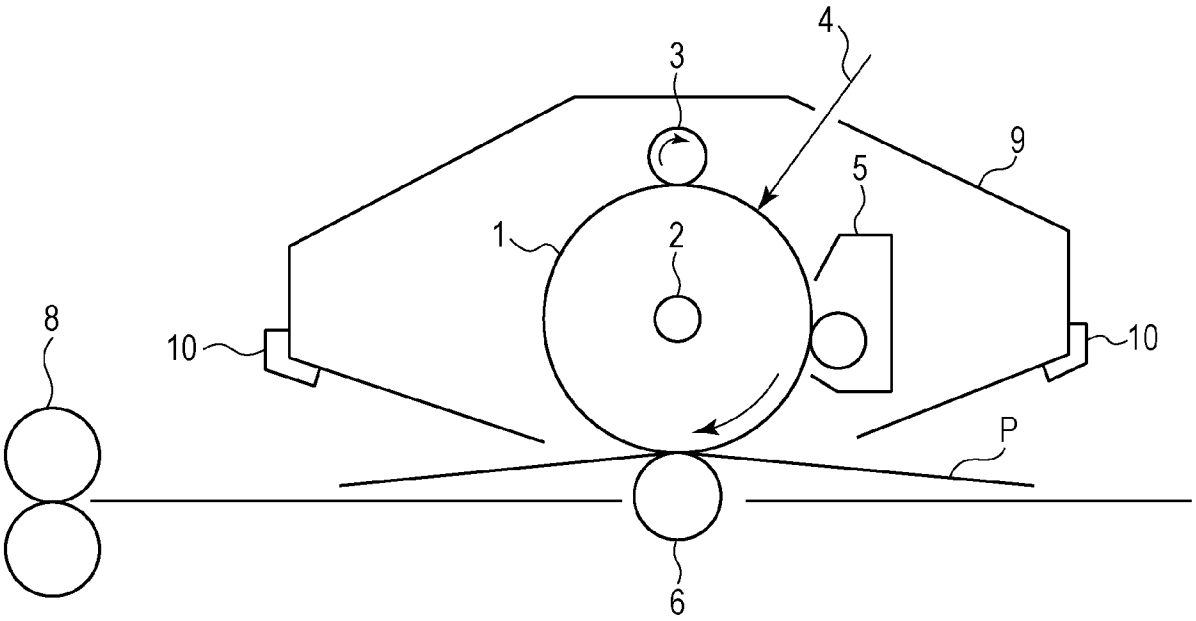
FIG. 1 illustrates an example of the schematic configuration of an electrophotographic apparatus including a process cartridge.

In FIG. 1, a cylindrical electrophotographic photosensitive member 1 is driven to rotate around a shaft 2 in a direction represented by arrow at a predetermined peripheral speed.

The peripheral surface of the electrophotographic photosensitive member 1 being driven to rotate is uniformly charged to a predetermined positive or negative potential by application of a direct current voltage (DC voltage, direct current voltage alone) with a charging roller 3 (charging step). Subsequently, the electrophotographic photosensitive member is subjected to exposure light (image exposure light) 4 output from an exposure device (image exposure device, not shown) such as a slit exposure device or a laser beam scanning exposure device. In this way, an electrostatic latent image corresponding to a target image is sequentially formed on the electrophotographic photosensitive member 1 (electrostatic latent image-forming step). The voltage applied to the charging roller 3 is a direct current voltage.

The electrostatic latent image formed on the electrophotographic photosensitive member 1 is developed with a toner of a developing device 5 to provide a toner image (developing step). Subsequently, the toner image formed on the electrophotographic photosensitive member 1 is transferred onto a transfer material (such as a paper sheet) P with a transfer bias applied by a transfer device (such as a transfer roller) 6 (transfer step). The transfer material P is transported in synchronization with the rotation of the electrophotographic photosensitive member 1 from a transfer material supply device (not shown) to the nip (contact portion) between the electrophotographic photosensitive member 1 and the transfer device 6. Incidentally, a configuration may be employed in which the toner image formed on the electrophotographic photosensitive member 1 is transferred onto the transfer material P via an intermediate transfer body (such as an intermediate transfer belt).

The transfer material P onto which the toner image has been transferred is separated from the peripheral surface of the electrophotographic photosensitive member 1, introduced into a fixing device 8 in which the image is fixed. The transfer material P is then discharged outside the apparatus as an image formed material (print or copy).

After the toner image has been transferred, the peripheral surface of the electrophotographic photosensitive member 1 is subjected to a static elimination treatment with a pre-exposure light emitted from a pre-exposure device (not shown) and is subsequently used again for image formation. Incidentally, in a case where the charging device is a contact charging device, the pre-exposure is not necessarily performed. After the transfer step, a residual toner left (remaining) on the electrophotographic photosensitive member is collected with the developing device in a subsequent electrophotographic process by cleaning simultaneously performed with development. Thus, the electrophotographic apparatus and the process cartridge do not have a cleaning blade.

The cleaning simultaneously performed with development is a method of collecting a toner left on the photosensitive member after the transfer step, with a fogging prevention bias (fogging prevention potential difference Vback, which is a potential difference between a direct current voltage applied to the developing device and the surface potential of the photosensitive member) during development in a subsequent step. By using this method, the residual toner is collected into the developing device and used again in a subsequent step. In order to collect the residual toner with the potential difference, the residual toner needs to be negatively charged.

Figure 6:
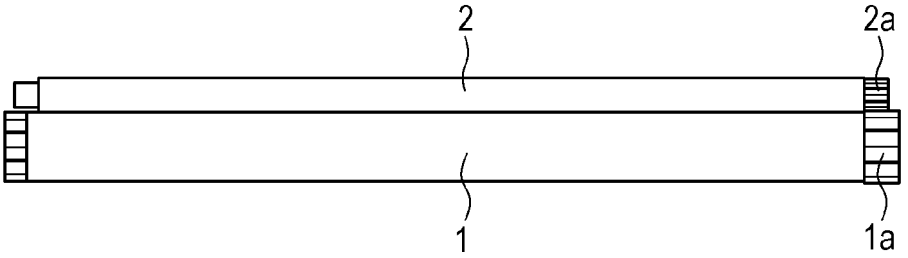
FIG. 6 is an explanatory view for a driving force transmission that transmits a driving force to an electrophotographic photosensitive member and a charging roller.

The above-described electrophotographic photosensitive member 1, charging roller 3, and developing device 5 are collectively supported to provide a process cartridge. This process cartridge is detachably attachable to the main body of the electrophotographic apparatus. According to an embodiment of the present invention, a peripheral speed difference is provided between the electrophotographic photosensitive member 1 and the charging roller 3. As a configuration that provides this peripheral speed difference, the electrophotographic photosensitive member and the charging roller are integrated. A driving force transmission is provided that transmits a driving force which causes rotation so that the contact portions of the electrophotographic photosensitive member and the charging roller move in the same direction and the peripheral speed of the charging roller is higher than the peripheral speed of the electrophotographic photosensitive member. As illustrated in FIG. 6, the driving force transmission has an electrophotographic photosensitive member gear 1*a* held by the electrophotographic photosensitive member 1 and a driven gear 2*a* held by the charging roller 2. This gear train from the electrophotographic photosensitive member gear 1*a* to the driven gear 2*a* is disposed so that the charging roller is driven in synchronization with the electrophotographic photosensitive member. By adjusting the gear ratio of the gears, the peripheral speed difference is provided.

Electrophotographic Photosensitive Member

Hereinafter, a cylindrical electrophotographic photosensitive member according to an embodiment of the present invention will be described. An electrophotographic photosensitive member according to an embodiment of the present invention includes a support, an undercoat layer on the support, and a photosensitive layer on the undercoat layer. There are two types of photosensitive layer: a single-layer type photosensitive layer in which a single layer contains a charge generation material and a charge transport material; and a multilayer type photosensitive layer including a charge generation layer containing a charge generation material and a charge transport layer containing a charge transport material. In particular, the multilayer type photosensitive layer can be used.

Figure 2A:
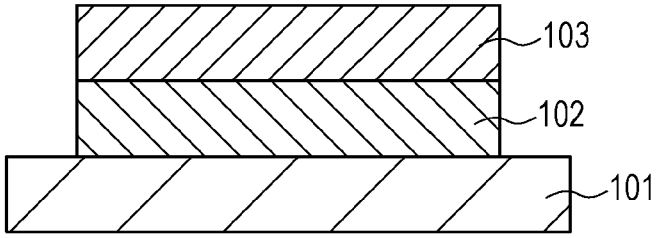
FIGS. 2A and 2B are explanatory views for examples of the layer configuration of an electrophotographic photosensitive member.
Figure 2B:
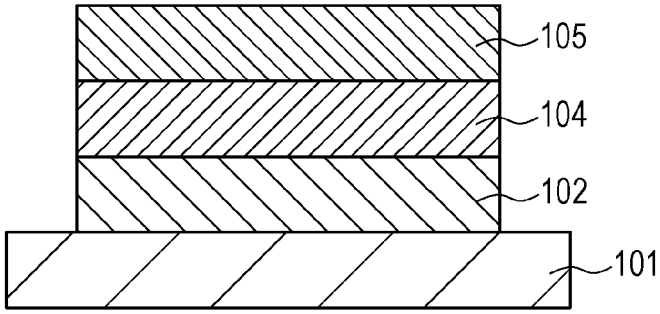

FIGS. 2A and 2B illustrate examples of the layer configuration of an electrophotographic photosensitive member according to an embodiment of the present invention. FIG. 2A illustrates a configuration in which an undercoat layer 102 is on a support 101 and a photosensitive layer 103 is on the undercoat layer 102. FIG. 2B illustrates a configuration in which an undercoat layer 102 is on a support 101, an intermediate layer 104 is on the undercoat layer 102, and a photosensitive layer 105 is on the intermediate layer 104.

Undercoat Layer

In an embodiment of the present invention, the undercoat layer contains metal oxide particles. The undercoat layer has a volume resistivity of $1\times10^{7}$ Ω·cm or more and $1\times10^{14}$ Ω·cm or less. In particular, in order to provide conductivity and uniform downstream discharging, the volume resistivity is preferably $1\times10^{11}$ Ω·cm or more and $1\times10^{14}$ Ω·cm or less.

Figure 3:
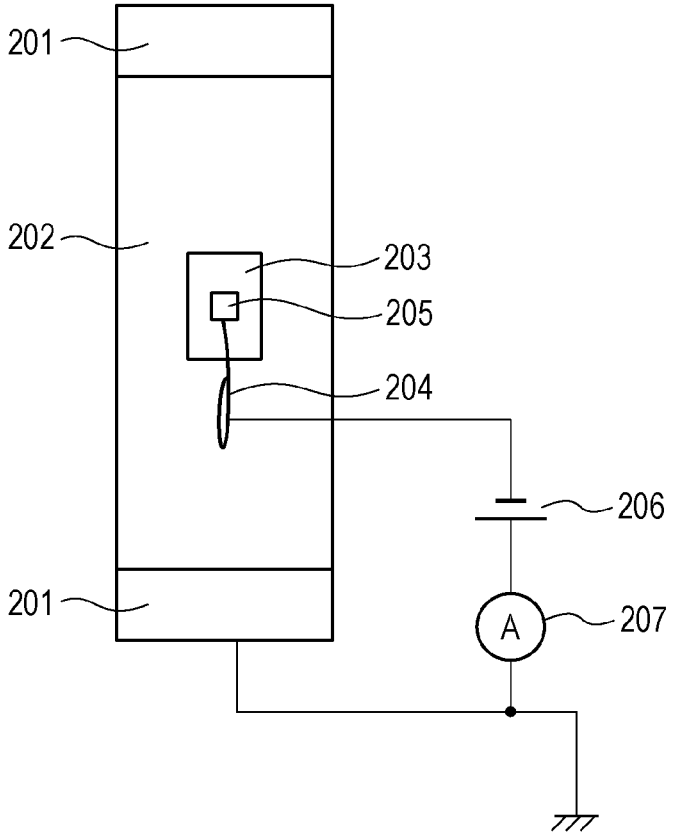
FIG. 3 is a top view illustrating a method of measuring the volume resistivity of an undercoat layer.
Figure 4:
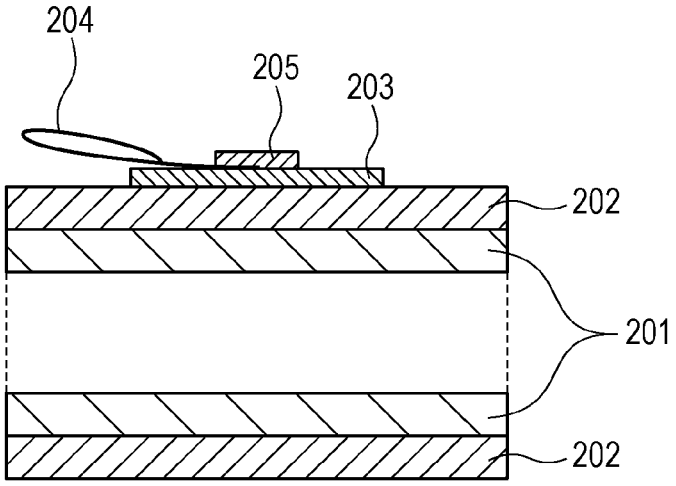
FIG. 4 is a sectional view illustrating a method of measuring the volume resistivity of an undercoat layer.

Referring to FIG. 3 and FIG. 4, a method of measuring the volume resistivity of the undercoat layer of the electrophotographic photosensitive member will be described. FIG. 3 is a top view illustrating the method of measuring the volume resistivity of the undercoat layer. FIG. 4 is a sectional view illustrating the method of measuring the volume resistivity of the undercoat layer.

The volume resistivity of the undercoat layer is measured at ordinary temperature and ordinary humidity (23° C./50% RH). A copper tape 203 (manufactured by Sumitomo 3M Limited, Product No. 1181) is attached to the front surface of an undercoat layer 202 and used as a front surface electrode of the undercoat layer 202. A support 201 is used as a back surface electrode of the undercoat layer 202. A power supply 206 for applying a voltage between the copper tape 203 and the support 201 is disposed. A current measurement instrument 207 for measuring current flowing between the copper tape 203 and the support 201 is disposed. In order to apply a voltage to the copper tape 203, a copper wire 204 is placed on the copper tape 203. In order to prevent the copper wire 204 from deviating from the copper tape 203, a copper tape 205 similar to the copper tape 203 is attached from above the copper wire 204 to fix the copper wire 204. A voltage is applied to the copper tape 203 via the copper wire 204.

The value calculated with the following numerical formula (1) is defined as the volume resistivity ρ (Ω·cm) of the undercoat layer 202.

$$\rho=1/(I-I_0)\times S/d(\Omega\cdot\mathrm{cm}) \quad (1)$$

In the formula, $I_0$ represents the background current value (A) when no voltage is applied between the copper tape 203 and the support 201; I represents a current value (A) when a voltage of −1 V constituted by a direct current voltage (direct current component) alone is applied; d represents the thickness (cm) of the undercoat layer 202; and S represents the area ($cm^2$) of the front surface electrode (copper tape 203) of the undercoat layer 202.

In this measurement, a low current value having an absolute value of $1\times10^{-6}$ A or less is measured. Accordingly, the current measurement instrument 207 can be an instrument that is designed to measure such a low current. An example of the instrument is a pA meter (trade name: 4140B) manufactured by Yokogawa-Hewlett-Packard Company.

Incidentally, the volume resistivity of the undercoat layer measured in a state where the undercoat layer alone is formed on the support is similar to the volume resistivity of the undercoat layer measured in a state where layers (such as a photosensitive layer) on the undercoat layer are removed from the electrophotographic photosensitive member to leave the undercoat layer alone on the support.

Examples of the metal oxide particles contained in the undercoat layer include tin oxide particles, zinc oxide particles, titanium oxide particles, aluminum oxide particles, and ITO particles.

In particular, from the standpoint of conductivity, particles containing at least one selected from the group consisting of tin oxide, zinc oxide, and titanium oxide can be used.

In order to suppress local charge injection to the photosensitive layer, the metal oxide particles are uniformly distributed within the undercoat layer. In order to achieve this uniform distribution, the metal oxide particles can have a number-average particle size of 300 nm or less, more preferably 30 nm or more and 300 nm or less. The number-average particle size of metal oxide particles is measured in the following manner.

A magnified sectional micrograph of metal oxide particles in the undercoat layer taken with a SEM (scanning electron microscope) is compared with a sectional elemental map of the metal oxide particles measured with an elemental analysis unit such as an XMA (X-ray microanalyzer) attached to the SEM. Subsequently, the projected primary particle areas of 100 metal oxide particles are measured. The diameter of an equivalent circle that has the same area as the measured projected area of each metal oxide particle is determined as the diameter of the metal oxide particle. On the basis of this result, the number-average particle size of metal oxide particles is calculated.

The undercoat layer can contain a binder resin. Examples of the binder resin include polyester resins, polycarbonate resins, polyvinyl butyral resins, acrylic resins, silicone resins, epoxy resins, melamine resins, urethane resins, phenol resins, and alkyd resins.

Of these, curable resins can be particularly used from the standpoint of, for example, suppression of migration (dissolution) to another layer (such as a photosensitive layer) and dispersibility and dispersion stability of metal oxide particles. Of such curable resins, phenol resins and polyurethane resins can be particularly used because dispersion of these resins with metal oxide particles causes an appropriately high degree of dielectric relaxation.

By changing the mass ratio of the metal oxide particles to the binder resin, the volume resistivity of the resultant undercoat layer can be controlled to thereby provide the undercoat layer having a desired volume resistivity. The mass ratio P/B of the metal oxide particles (P) to the binder resin (B) can be 1/1 or more and 4/1 or less from the standpoint of suppression of cracking and control of volume resistivity.

The undercoat layer preferably has a thickness of 10 μm or more and 40 μm or less, more preferably 10 μm or more and 30 μm or less.

Examples of a solvent used for an undercoat layer-forming coating liquid include alcohols such as methanol, ethanol, isopropanol, and 1-methoxy-2-propanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

The undercoat layer may contain a surface roughening material from the standpoint of suppression of interference fringes. The surface roughening material can be resin particles having an average particle size of 1 μm or more and 5 μm or less (preferably 3 μm or less). Examples of the resin particles include particles of curable resins such as curable rubbers, polyurethanes, epoxy resins, alkyd resins, phenol resins, polyesters, silicone resins, and acrylic-melamine resins. Of these, particles of silicone resins and particles of acrylic-melamine resins (polymethyl methacrylate (PMMA) particles) can be particularly used. The content of the surface roughening material relative to the binder resin within the undercoat layer is preferably 1% to 80% by mass, more preferably 1% to 40% by mass.

The undercoat layer-forming coating liquid may contain a leveling agent for improving the surface property of the undercoat layer. The undercoat layer may contain pigment particles for improving the masking property of the undercoat layer.

Charging Roller

A charging roller according to an embodiment of the present invention may have a single-layer configuration including a metal core and an elastic layer formed around the metal core, or a two-layer configuration in which a surface layer is formed on such an elastic layer.

The elastic layer is formed of a rubber component. The rubber component is not particularly limited and known rubbers in the field of charging members can be used. Specific examples of such rubbers include epichlorohydrin homopolymers, epichlorohydrin-ethylene oxide copolymers, epichlorohydrin-ethylene oxide-allyl glycidyl ether terpolymers, acrylonitrile-butadiene copolymers, hydrogenated acrylonitrile-butadiene copolymers, silicone rubbers, acrylic rubbers, and urethane rubbers.

The surface layer can be formed with a resin known in the field of charging members. Specific examples of the resin include acrylic resins, polyurethanes, polyamides, polyesters, polyolefins, and silicone resins. The surface layer may contain carbon black, graphite; a conductive oxide such as tin oxide; a metal such as copper or silver; conductive particles produced by covering the surfaces of particles with an oxide or a metal to provide conductivity; and an ion conductive agent having an ion exchange capability such as a quaternary ammonium salt.

The charging roller can have a volume resistivity of $1\times10^{6}$ Ω·cm or more and $1\times10^{14}$ Ω·cm or less, preferably $1\times10^{7}$ Ω·cm or more and $1\times10^{9}$ Ω·cm or less.

In a case where the volume resistivity of the charging roller is set to $1\times10^{7}$ Ω·cm or more, the amount of downstream discharging considerably increases. Thus, a residual toner having passed over the charging roller is subjected to the downstream discharging and, as a result, the residual toner can be negatively charged, which facilitates collection of the residual toner with the developing device. In addition, by setting the volume resistivity of the charging roller to be $1\times10^{9}$ Ω·cm or less, occurrence of image defects due to insufficient electric resistance can be further suppressed.

For the hardness of the charging roller, the universal hardness of the surface of the charging roller into which an indenter is being pressed by 1 μm can be 1.0 N/mm$^2$ or more and 10.0 N/mm$^2$ or less. By setting the hardness to be 1.0 N/mm$^2$ or more, occurrence of image defects can be suppressed, the image defects being caused by deformation of the charging roller after the charging roller and the electrophotographic photosensitive member are in contact with each other in a nonoperational state for a long period of time. By setting the hardness to be 10.0 N/mm$^2$ or less, the nip between the charging roller and the electrophotographic photosensitive member can be sufficiently ensured and downstream discharging can be caused with stability.

The universal hardness of the surface of the charging roller is measured with, for example, a universal hardness meter (trade name: microhardness measurement instrument H-100V, manufactured by Fisher). The universal hardness is a property value determined by pressing an indenter under a load into a measurement sample, and is calculated with the formula of test load/surface area of indenter under test load (N/mm$^2$). Specifically, an indenter having the shape of, for example, a quadrangular pyramid is pressed under a predetermined relatively low test load into a measurement sample; when the indenter reaches a predetermined indentation depth, on the basis of the indentation depth, the surface area of the indenter in contact with the sample is measured; and the surface area is substituted into the formula to calculate the universal hardness.

An electrophotographic photosensitive member and a charging roller according to an embodiment of the present invention are rotated in a direction such that the contact portion of the electrophotographic photosensitive member and the contact portion of the charging roller move in the same direction, the contact portions being in contact with each other. In contrast, in a case where the rotation is caused such that the contact portions individually move in directions opposite to each other, a residual toner tends not to pass through the nip portion between the electrophotographic photosensitive member and the charging roller. Thus, the residual toner tends to be left on the surface of the electrophotographic photosensitive member. As a result, the residual toner accumulates, so that image defects due to charging failure or fusion of toner tend to occur.

In an embodiment of the present invention, a peripheral speed difference is provided between the electrophotographic photosensitive member and the charging roller. As a result, passing of a residual toner through the nip portion between the electrophotographic photosensitive member and the charging roller is facilitated; in addition, during passing through the nip portion, the residual toner rubs against the charging roller, so that the residual toner tends to be negatively charged. By thus negatively charging the residual toner, the residual toner is more easily collected with a developing device (developing roller). By setting the peripheral speed of the charging roller to be higher than the peripheral speed of the electrophotographic photosensitive member, a portion of the surface of the charging roller, the portion facing the electrophotographic photosensitive member, is refreshed, so that more uniform discharging can be performed.

By rotating the electrophotographic photosensitive member and the charging roller in the above-described manner in terms of rotation direction and peripheral speed difference, the residual toner can be negatively charged by triboelectric charging efficiently and uniformly. However, triboelectric charging caused at the nip portion between the electrophotographic photosensitive member and the charging roller disturbs the surface potential formed by discharging at an upstream portion of the nip, resulting in a nonuniform surface potential.

For this reason, in an embodiment according to the present invention, the undercoat layer of the electrophotographic photosensitive member is formed so as to contain metal oxide particles to thereby set the volume resistivity of the undercoat layer to be within the above-described specific range. This probably results in occurrence of stable discharging at a downstream portion of the nip. The reason for this is probably as follows. The metal oxide particles are contained, so that dielectric polarization probably occurs at metal oxide particle interfaces; and the volume resistivity is set to be within the above-described range, so that dielectric polarization probably occurs at the interface between the undercoat layer and the photosensitive layer. As a result, the surface potential of electrophotographic photosensitive member decreases during passing through the nip, so that a sufficiently high potential difference that causes stable gap charging is probably formed between the electrophotographic photosensitive member and the charging roller. This downstream discharging makes the disturbed surface potential uniform, the surface potential having been disturbed by triboelectric charging for the residual toner at the nip portion. As a result, stable images can be formed. In addition, the downstream discharging allows the residual toner to be further negatively charged.

Thus, a configuration according to an embodiment the present invention allows the capability of collecting a residual toner and the capability of performing uniform charging to be provided at high levels.

Hereinafter, components (other than the undercoat layer) of the electrophotographic photosensitive member will be described.

The electrophotographic photosensitive member/charging roller ratio of the outer diameter of the electrophotographic photosensitive member to the outer diameter of the charging roller can be 25/10 or less. In a case where the outer diameter ratio is 25/10 or less, a broad nip portion is provided between the electrophotographic photosensitive member and the charging roller, which facilitates negative charging of a residual toner by triboelectric charging. Specifically, the electrophotographic photosensitive member can have an outer diameter of 20 mm or more and 24 mm or less. In an embodiment according to the present invention, the outer diameter of the electrophotographic photosensitive member is determined as the outer diameter of the support. The coating films such as the undercoat layer and the photosensitive layer on the support are sufficiently thin films and are not considered for the outer diameter of the electrophotographic photosensitive member. The charging roller can have an outer diameter of 9 mm or more and 11 mm or less.

Support

The support can be a support having conductivity (conductive support). Examples of the support include metal supports formed of a metal or an alloy, such as aluminum, an aluminum alloy, or stainless steel. In the case of using aluminum or an aluminum alloy, the support can be an aluminum tube produced by a method including an extrusion step and a drawing step or an aluminum tube produced by a method including an extrusion step and an ironing step.

An intermediate layer may be formed between the undercoat layer and the photosensitive layer for the purpose of imparting electrical barrier properties that prevent charge injection from the undercoat layer to the photosensitive layer.

Intermediate Layer

The intermediate layer can be formed by applying an intermediate layer-forming coating liquid containing a resin (binder resin) onto the undercoat layer and drying the applied liquid.

Examples of the resin (binder resin) used for forming the intermediate layer include polyvinyl alcohol, polyvinyl methyl ether, polyacrylic acids, methylcellulose, ethylcellulose, polyglutamic acid, polyamide, polyimide, polyamide-imide, polyamic acid, melamine resins, epoxy resins, polyurethanes, and polyglutamic acid esters.

The undercoat layer can have a thickness of 0.1 μm or more and 2 μm or less.

In order to promote the flow of charges from the photosensitive layer to the support, the intermediate layer may be formed so as to contain a polymer of a composition containing an electron transport material having a reactive functional group (polymerizable functional group) and a crosslinking agent. In this way, during formation of the photosensitive layer on the intermediate layer, it is possible to suppress dissolution of the material of the intermediate layer into the solvent of the photosensitive layer-forming coating liquid.

Examples of the electron transport material include quinone compounds, imide compounds, benzimidazole compounds, and cyclopentadienylidene compounds.

Examples of the reactive functional group include a hydroxy group, a thiol group, an amino group, a carboxyl group, and a methoxy group.

In the intermediate layer, the content of the electron transport material having a reactive functional group in the composition can be 30% by mass or more and 70% by mass or less.

Specific examples of the electron transport material having a reactive functional group are as follows.

(A1)

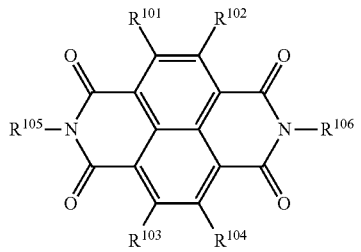

-continued (A2)

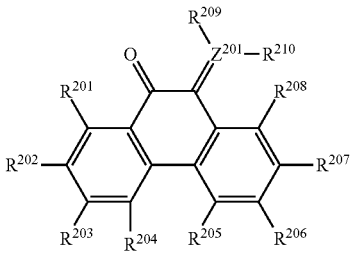

(A3)

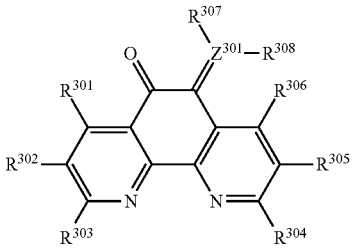

(A4)

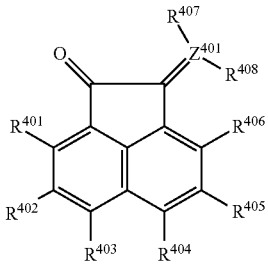

(A5)

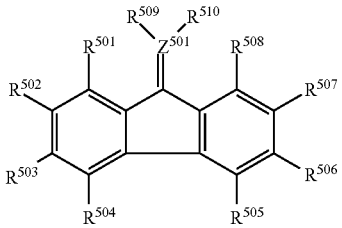

(A6)

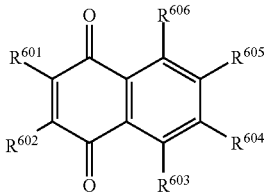

(A7)

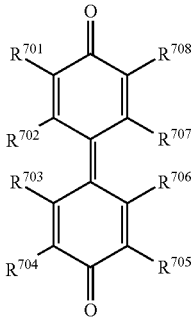

-continued (A8)

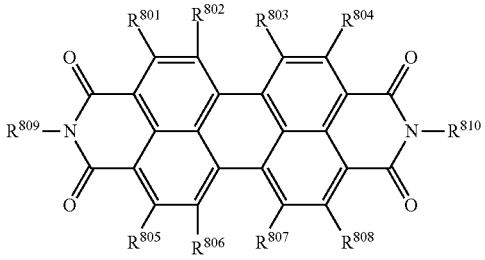

(A9)

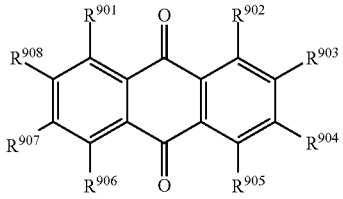

In the formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, and $R^{901}$ to $R^{908}$ each independently represent a monovalent group represented by a formula (1) or (2) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. The substituent of the substituted alkyl group is an alkyl group, an aryl group, a halogen atom, or a carbonyl group. The substituent of the substituted aryl group or the substituted heterocyclic group is a halogen atom, a nitro group, a cyano group, an alkyl group, a halo-substituted alkyl group, an alkoxy group, or a carbonyl group. $Z^{201}$, $Z^{301}$, $Z^{401}$, and $Z^{501}$ each independently represent a carbon atom, a nitrogen atom, or an oxygen atom. In a case where $Z^{201}$ represents an oxygen atom, $R^{209}$ and $R^{210}$ are not present. In a case where $Z^{201}$ represents a nitrogen atom, $R^{210}$ is not present. In a case where $Z^{301}$ represents an oxygen atom, $R^{307}$ and $R^{308}$ are not present. In a case where $Z^{301}$ represents a nitrogen atom, $R^{308}$ is not present. In a case where $Z^{401}$ represents an oxygen atom, $R^{407}$ and $R^{408}$ are not present. In a case where $Z^{401}$ represents a nitrogen atom, $R^{408}$ is not present. In a case where $Z^{501}$ represents an oxygen atom, $R^{509}$ and $R^{510}$ are not present. In a case where $Z^{501}$ represents a nitrogen atom, $R^{510}$ is not present.

At least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$, and at least one of $R^{901}$ to $R^{908}$ represent a group represented by the following formula (1) or (2).

$$-A \tag{1}$$

$$-(B)_l-C-D \tag{2}$$

In the formulae (1) and (2), at least one of A, B, C, and D represents a group having a reactive functional group; and this reactive functional group is a hydroxy group, a thiol group, an amino group, or a carboxyl group. The symbol l represents 0 or 1.

A represents a carboxyl group, a substituted or unsubstituted alkyl group whose main chain has 1 to 6 atoms, a group whose main chain has 1 to 6 atoms, the group being a group in which one carbon atom in the main chain of a substituted or unsubstituted alkyl group is substituted with an oxygen atom, or a group whose main chain has 1 to 6 atoms, the group being a group in which one carbon atom in the main chain of a substituted or unsubstituted alkyl group is substituted with $NR^1$. $R^1$ represents a hydrogen atom or an alkyl group. The substituent of the substituted alkyl group is at least one selected from the group consisting of alkyl groups having 1 to 6 carbon atoms, a benzyl group, a phenyl group, a hydroxy group, a thiol group, an amino group, and a carboxyl group.

B represents a substituted or unsubstituted alkylene group whose main chain has 1 to 6 atoms, a group whose main chain has 1 to 6 atoms, the group being a group in which one carbon atom in the main chain of a substituted or unsubstituted alkylene group is substituted with an oxygen atom, or a group whose main chain has 1 to 6 atoms, the group being a group in which one carbon atom in the main chain of a substituted or unsubstituted alkylene group is substituted with $NR^2$. $R^2$ represents a hydrogen atom or an alkyl group. The substituent of the substituted alkylene group is at least one selected from the group consisting of alkyl groups having 1 to 6 carbon atoms, a benzyl group, alkoxycarbonyl groups, a phenyl group, a hydroxy group, a thiol group, an amino group, and a carboxyl group.

C represents a phenylene group, a $C_{1-6}$-alkyl-substituted phenylene group, a nitro-substituted phenylene group, a halo-substituted phenylene group, or an alkoxy-substituted phenylene group. These groups may further have, as a reactive functional group, at least one group selected from the group consisting of a hydroxy group, a thiol group, an amino group, and a carboxyl group.

D represents a hydrogen atom or a substituted or unsubstituted alkyl group whose main chain has 1 to 6 atoms. The substituent of the substituted alkyl group is at least one selected from the group consisting of alkyl groups having 1 to 6 carbon atoms, a hydroxy group, a thiol group, an amino group, and a carboxyl group.

Specific examples of the electron transport material having a reactive functional group will be described below. Table 1 describes specific examples of the compound represented by the formula (A1) above.

TABLE 1
| Example compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A101 | H | H | H | H | 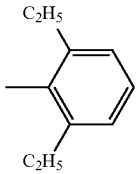 | (1) | 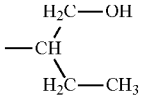 | — | — | — | — | — | — | — |
| A102 | H | H | H | H | 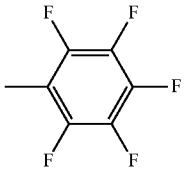 | (1) | —COOH | — | — | — | — | — | — | — |
| A103 | CN | H | H | CN | 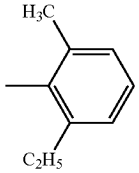 | (2) | — | — | 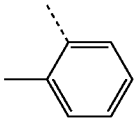 | 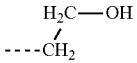 | — | — | — | — |
| A104 | H | $NO_2$ | H | $NO_2$ | 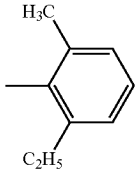 | (1) | 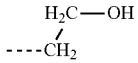 | — | — | — | — | — | — | — |
| A105 | F | H | H | F | (2) | (2) | — | — | 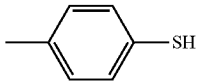 | — | — | — | — | — |
| A106 | H | H | H | H | 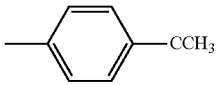 | (2) | — | — | 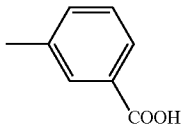 | — | — | — | — | — |

TABLE 1-continued
| Example compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A107 | H | H | H | H | 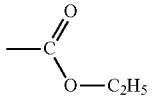 | (2) | — | — | 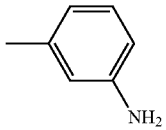 | — | — | — | — | — |
| A108 | H | H | H | H | 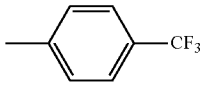 | (2) | — | — | 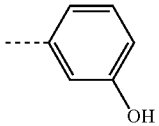 | — | — | — | — | — |
| A109 | H | H | H | H | 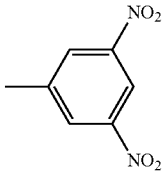 | (2) | — | — | 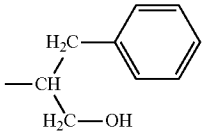 | — | — | — | — | — |
| A110 | H | H | H | H | 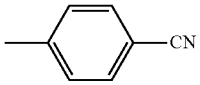 | (2) | — | — | 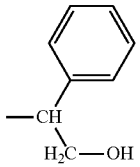 | — | — | — | — | — |
| A111 | H | H | H | H | 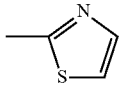 | (1) | 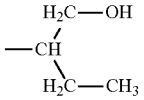 | — | — | — | — | — | — | — |
| A112 | H | H | H | H | 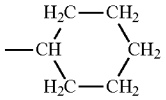 | (1) | 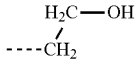 | — | — | — | — | — | — | — |
| A113 | H | H | H | H | 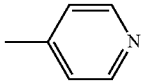 | (2) | — | —$CH_2CH_2$---- | 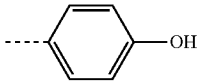 | — | — | — | — | — |

TABLE 1-continued
| Example compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A114 | H | H | H | H | 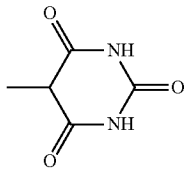 | (2) | — | — | 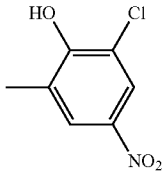 | — | — | — | — | — |
| A115 | H | H | H | H | $-C_2H_4-O-C_2H_5$ | (2) | — | — | 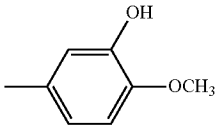 | — | — | — | — | — |
| A116 | H | H | H | H | 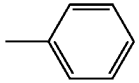 | (1) | $-(CH_2)_5-OH$ | — | — | — | — | — | — | — |
| A117 | H | H | H | H | (2) | (2) | — | — | 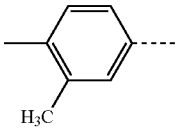 | 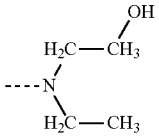 | — | — | — | — |
| A118 | H | H | H | H | (2) | (1)' | — | — | 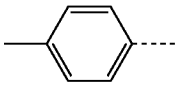 | 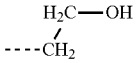 | 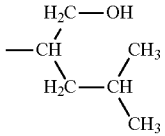 | — | — | — |
| A119 | H | H | H | H | (1) | (1) | 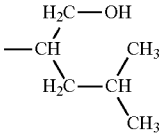 | — | — | — | — | — | — | — |
| A120 | H | H | H | H | (1) | (1)' | 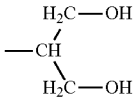 | — | — | — | 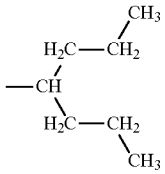 | — | — | — |

The derivatives having the structure represented by (A1) (derivatives serving as electron transport materials) can be synthesized by reactions between a monoamine derivative and naphthalene tetracarboxylic acid dianhydride available from TOKYO CHEMICAL INDUSTRY CO., LTD. or Sigma-Aldrich Japan K.K.

The compounds represented by (A1) to (A9) have a reactive functional group (a hydroxy group, a thiol group, an amino group, or a carboxyl group), which is polymerizable with a crosslinking agent. In order to introduce such a reactive functional group into derivatives having structures represented by (A1) to (A9), one of the following two methods can be used. The first method is to directly introduce a reactive functional group into derivatives having structures represented by (A1) to (A9). The second method is to introduce a structure having a reactive functional group or a functional group serving as a precursor of a reactive functional group, into derivatives having structures represented by (A1) to (A9). The second method may be a method of causing a cross-coupling reaction of halogenated derivatives having structures represented by (A1) to (A9) with a palladium catalyst and a base to introduce a functional-group-containing aryl group; or a method of causing a cross-coupling reaction of halogenated derivatives having structures represented by (A1) to (A9) with a $FeCl_3$ catalyst and a base to introduce a functional-group-containing alkyl group; or a method of subjecting halogenated derivatives having structures represented by (A1) to (A9) to lithiation and causing the resultant compounds to react with epoxy compounds or $CO_2$ to introduce a hydroxyalkyl group or a carboxyl group.

Crosslinking Agent

Hereinafter, the crosslinking agent will be described.

The crosslinking agent can be a compound that is polymerizable or crosslinkable with an electron transport material having a reactive functional group and a thermoplastic resin having a reactive functional group described later. Specific examples of the crosslinking agent include compounds described in "Kakyozai Handbook [Handbook of crosslinking agents]" edited by Shinzo Yamashita and Tousuke Kaneko and published by Taiseisha Ltd. (1981).

The crosslinking agent can be an isocyanate compound. The isocyanate compound can have a molecular weight of 200 to 1300. The isocyanate compound can have two or more isocyanate groups or blocked isocyanate groups, more preferably three to six isocyanate groups or blocked isocyanate groups. Examples of the isocyanate compound include triisocyanatobenzene, triisocyanatomethylbenzene, triphenylmethane triisocyanate, lysine triisocyanate; and isocyanurate modification compounds, biuret modification compounds, allophanate modification compounds, and adduct modification compounds (using trimethylolpropane or pentaerythritol) of diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanato hexanoate, and norbornane diisocyanate. Of these, isocyanurate modification compounds and adduct modification compounds can be particularly used.

The blocked isocyanate group has a structure represented by —NHCOX[1] (where $X^1$ represents a protecting group). $X^1$ represents any protecting group that can be introduced into an isocyanate group; $X^1$ can be selected from groups represented by the following formulae (1) to (7).

(1)

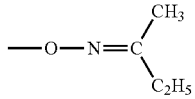

(2)

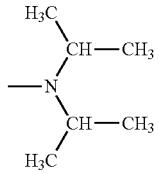

(3)

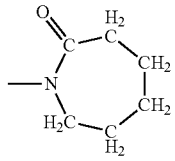

(4)

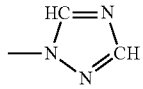

(5)

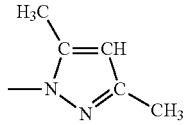

(6)

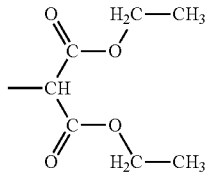

(7)

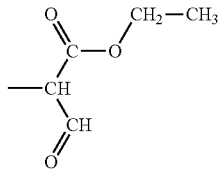

Specific examples of the isocyanate compound are as follows.

(B1)

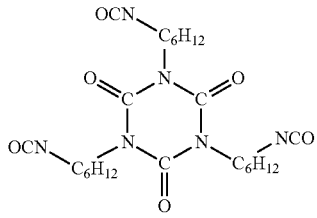

-continued (B2)

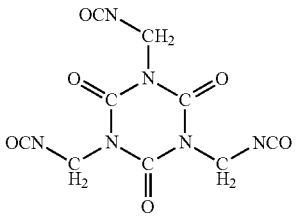

(B3)

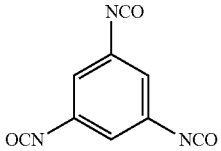

(B4)

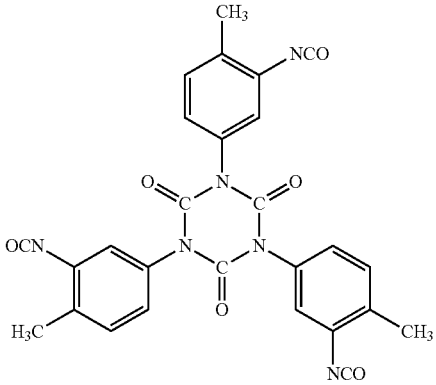

(B5)

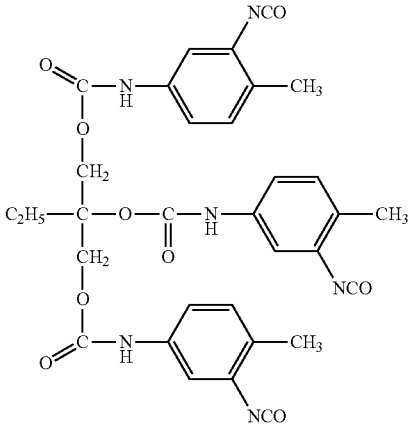

(B6)

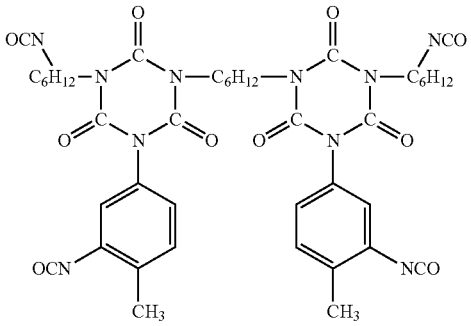

-continued (B7)

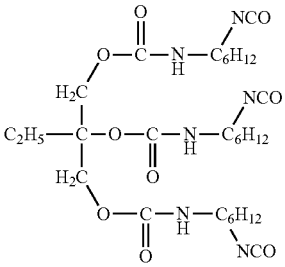

(B8)

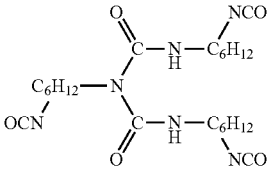

(B9)

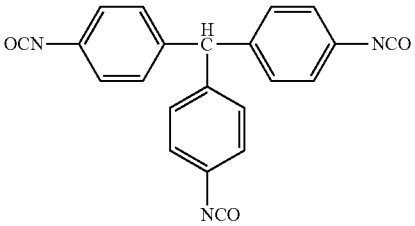

(B10)

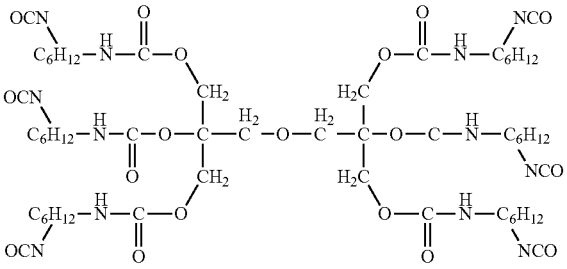

The composition containing the electron transport material having a reactive functional group and the crosslinking agent may further contain a thermoplastic resin having a reactive functional group. The thermoplastic resin having a reactive functional group can be a thermoplastic resin having a structural unit represented by the following formula (D) (hereafter also referred to as resin D).

(D)

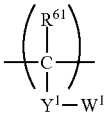

In the formula (D), $R^{61}$ represents a hydrogen atom or an alkyl group. $Y^1$ represents a single bond, an alkylene group, or a phenylene group. $W^1$ represents a hydroxy group, a thiol group, an amino group, a carboxyl group, or a methoxy group.

Examples of the thermoplastic resin having the structural unit represented by the formula (D) include polyvinyl butyral, acetal resins, polyolefin resins, polyester resins, polyether resins, and polyamide resins.

Some resins corresponding to the resin D are commercially available. Examples of the commercially available resins include polyether polyol resins such as AQD-457 and AQD-473 manufactured by Nippon Polyurethane Industry Co., Ltd. and SANNIX GP-400 and GP-700 manufactured by Sanyo Chemical Industries, Ltd.; polyester polyol resins such as Phthalkyd W2343 manufactured by Hitachi Chemical Company, Ltd., WATERSOL S-118, CD-520, BECKOLITE M-6402-50, and M-6201-40IM manufactured by DIC Corporation, HARIDIP WH-1188 manufactured by Harima Chemicals Group, Inc., and ES3604 and ES6538 manufactured by Japan U-pica. co. ltd.; polyacrylic polyol resins such as BURNOCK WE-300 and WE-304 manufactured by DIC Corporation; polyvinyl alcohol resins such as KURARAY POVAL PVA-203 manufactured by KURARAY CO., LTD.; polyvinyl acetal resins such as BX-1 and BM-1 manufactured by SEKISUI CHEMICAL CO., LTD.; polyamide resins such as TORESIN FS-350 manufactured by Nagase ChemteX Corporation; carboxyl group-containing resins such as AQUALIC manufactured by NIPPON SHOKUBAI CO., LTD. and FINELEX SG2000 manufactured by Namariichi Co., Ltd.; polyamine resins such as LUCKAMIDE manufactured by DIC Corporation; and polythiol resins such as QE-340M manufactured by Toray Industries, Inc. Of these, polyvinyl acetal resins and polyester polyol resins can be particularly used. The resin D can have a weight-average molecular weight (Mw) of 5000 to 300000.

Photosensitive Layer

The photosensitive layer is formed on the undercoat layer or the intermediate layer. The photosensitive layer can be a multilayer type photosensitive layer including a charge generation layer and a charge transport layer.

Examples of the charge generation material include azo pigments, phthalocyanine pigments, indigo pigments such as indigo and thioindigo, perylene pigments, polycyclic quinone pigments, Squarylium pigments, pyrylium salts, thiopyrylium salts, triphenylmethane pigments, quinacridone pigments, azulenium salt pigments, cyanine dyes, xanthene dyes, quinonimine pigments, and styryl pigments. Of these, metal phthalocyanines such as oxytitanium phthalocyanine, hydroxygallium phthalocyanine, and chlorogallium phthalocyanine can be particularly used.

In a case where the photosensitive layer is a multilayer type photosensitive layer, the charge generation layer can be formed by applying a charge generation layer-forming coating liquid prepared by dispersing a charge generation material and a binder resin in a solvent, and by drying the applied liquid. The dispersion can be performed with, for example, a homogenizer, ultrasonic waves, a ball mill, a sand mill, an attritor, or a roll mill.

Examples of the binder resin used for the charge generation layer include polycarbonates, polyesters, polyarylates, butyral resins, polystyrenes, polyvinyl acetals, diallyl phthalate resins, acrylic resins, methacrylic resins, vinyl acetate resins, phenol resins, silicone resins, polysulfones, styrene-butadiene copolymers, alkyd resins, epoxy resins, urea resins, and vinyl chloride-vinyl acetate copolymers. These resins can be used alone or in combination of two or more thereof in the form of a mixture or a copolymer.

The mass ratio of the charge generation material to the binder resin (charge generation material:binder resin) can be 10:1 to 1:10, more preferably 5:1 to 1:1, still more preferably 3:1 to 1:1.

Examples of the solvent used for the charge generation layer-forming coating liquid include alcohols, sulfoxides, ketones, ethers, esters, halogenated aliphatic hydrocarbons, and aromatic compounds.

The charge generation layer can have a thickness of 0.1 μm or more and 5 μm or less, preferably 0.1 μm or more and 2 μm or less.

The charge generation layer can be formed so as to contain various additives such as sensitizers, antioxidants, UV absorbing agents, and plasticizers according to the need. In order to keep sufficient flow of charges in the charge generation layer, the charge generation layer can be formed so as to contain an electron transport material (electron receiving substance such as an acceptor).

In a case where the photosensitive layer is a multilayer type photosensitive layer, the charge transport layer can be formed by forming a coating film with a charge transport layer-forming coating liquid prepared by dissolving a charge transport material and a binder resin in a solvent, and by drying the coating film.

Specific examples of the charge transport material include hydrazone compounds, styryl compounds, benzidine compounds, triarylamine compounds, and triphenylamine compounds.

Specific examples of the binder resin include acrylic resins, styrene resins, polyesters, polycarbonates, polyarylates, polysulfones, polyphenylene oxides, epoxy resins, polyurethanes, and alkyd resins. In particular, polyesters, polycarbonates, and polyarylates can be used. These resins can be used alone or in combination of two or more thereof in the form of a mixture or a copolymer.

The mass ratio of the charge transport material to the binder resin (charge transport material:binder resin) can be 2:1 to 1:2.

Examples of the solvent used for the charge transport layer-forming coating liquid include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted with halogen atoms, such as chlorobenzene, chloroform, and carbon tetrachloride.

The charge transport layer can have a thickness of 3 μm or more and 40 μm or less, preferably 5 μm or more and 30 μm or less.

The charge transport layer can be formed so as to contain an antioxidant, an UV absorbing agent, and a plasticizer according to the need.

A protective layer may be formed on the photosensitive layer for the purpose of protecting the photosensitive layer.

The protective layer can be formed by forming a coating film with a protective layer-forming coating liquid containing a resin (binder resin), and by drying and/or curing this coating film.

Examples of the binder resin for forming the protective layer include phenol resins, acrylic resins, polystyrenes, polyesters, polycarbonates, polyarylates, polysulfones, polyphenylene oxides, epoxy resins, polyurethanes, alkyd resins, and siloxane resins. These resins can be used alone or in combination of two or more thereof in the form of a mixture or a copolymer.

The protective layer can have a thickness of 0.5 μm or more and 10 μm or less, preferably 1 μm or more and 8 μm or less.

The coating liquids for forming the above-described layers can be applied by coating methods such as an immersion coating method, a spray coating method, a spinner coating method, a roller coating method, a Meyer bar coating method, and a blade coating method.

EXAMPLES

Hereinafter, the present invention will be described further in detail with reference to specific examples. However, the present invention is not limited to these examples. The term "parts" in the following section means "parts by mass".

Preparation of Undercoat Layer-Forming Coating Liquids

Preparation of Undercoat Layer-Forming Coating Liquid 1

Zinc oxide particles (100 parts, specific surface area: 19 $m^2/g$, powder resistivity: $1.0\times10^7$ Ω·cm, number-average particle size: 50 nm) were mixed with 500 parts of toluene under stirring. To this mixture, 1.5 parts of N-(2-aminoethyl)-3-aminopropylmethyldimethoxysilane (trade name: KBM602, manufactured by Shin-Etsu Chemical Co., Ltd.) serving as a silane coupling agent (surface treatment agent) was added and the resultant solution was mixed for 6 hours by stirring. After that, toluene was evaporated under reduced pressure and the resultant particles were dried at 140° C. for 6 hours. Thus, zinc oxide particles surface-treated with the silane coupling agent were obtained.

Subsequently, 15 parts of a butyral resin (trade name: BM-1, manufactured by SEKISUI CHEMICAL CO., LTD.) serving as a polyol resin and 15 parts of a blocked isocyanate resin (trade name: TPA-B80E, 80% solution, manufactured by Asahi Chemical Industry Co., Ltd.) were dissolved in a solvent mixture composed of 73.5 parts of methyl ethyl ketone and 73.5 parts of cyclohexanone to provide a solution.

To this solution, 81 parts of the zinc oxide particles surface-treated with the silane coupling agent and 0.8 parts of 2,3,4-trihydroxybenzophenone (manufactured by TOKYO CHEMICAL INDUSTRY CO., LTD.) were added. The resultant solution was placed as a dispersion medium into a vertical sand mill using 180 parts of glass beads having an average particle size of 1.0 mm and subjected to a dispersion treatment in an atmosphere at 23±3° C. at 1500 rpm (peripheral speed: 5.5 m/s) for 4 hours.

After the dispersion treatment was performed, to the resultant dispersion liquid, 0.01 parts of a silicone oil (trade name: SH28PA, manufactured by Dow Corning Toray Silicone Co., Ltd.) and 5.6 parts of crosslinked polymethyl methacrylate (PMMA) particles (trade name: TECHPOLYMERSSX-102, manufactured by SEKISUI PLASTICS CO., Ltd., average primary particle size: 2.5 μm) were added. The resultant solution was stirred to thereby prepare an undercoat layer-forming coating liquid.

Preparation of Undercoat Layer-Forming Coating Liquid 3

Titanium oxide particles (200 g, number-average particle size of primary particles: 200 nm) were dispersed in 3 L of water. To the resultant dispersion liquid, 208 g of sodium stannate ($Na_2SnO_3$) having a tin content of 41% was added and dissolved to provide a mixture slurry.

While this mixture slurry was circulated, the mixture slurry was subjected to ultrasonic waves (40 kHz, 570 W) and, to the mixture slurry, 20% aqueous solution of sulfuric acid (dilute sulfuric acid) was added to neutralize tin. This aqueous solution of sulfuric acid was added over 98 minutes until the pH of mixture slurry decreased to 2.5. After the neutralization was performed, aluminum chloride (in an amount of 8 mol % relative to Sn content) was added to the mixture slurry and the mixture slurry was stirred. As a result, a precursor of the target conductive particles was obtained.

This precursor was rinsed with warm water and subsequently subjected to dehydration-filtration, so that precursor cake was collected. This cake was placed in a horizontal tube furnace and subjected to reduction firing in a 2 vol % $H_2/N_2$ atmosphere at 500° C. for 1 hour, to thereby provide the target particles, conductive particles 3 (aluminum-doped tin-oxide-coated titanium oxide particles (number-average particle size: 220 nm)).

Subsequently, 219 parts of the conductive particles 3, 146 parts of a phenol resin (trade name: Plyophen J-325, manufactured by Dainippon Ink and Chemicals, resin solid content: 60%) serving as a binder resin, and 106 parts of 1-methoxy-2-propanol as a solvent were placed into a sand mill using 420 parts of glass beads having a diameter of 1.0 mm and subjected to a dispersion treatment under conditions (number of revolutions: 2000 rpm, dispersion treatment time: 4 hours, temperature of cooling water: 18° C.) to prepare a dispersion liquid. From this dispersion liquid, the glass beads were removed with a mesh. After that, to the dispersion liquid, 23.7 parts of silicone resin particles (trade name: TOSPEARL 120, manufactured by Momentive Performance Materials Inc., average particle size: 2 μm), 0.024 parts of silicone oil (trade name: SH28PA), 6 parts of methanol, and 6 parts of 1-methoxy-2-propanol were added. The resultant solution was stirred to thereby prepare an undercoat layer-forming coating liquid 3. Preparation of undercoat layer-forming coating liquid 4

An undercoat layer-forming coating liquid 4 was obtained as with the undercoat layer-forming coating liquid 3 except that, in the method of preparing the undercoat layer-forming coating liquid 3, the amount of sodium stannate ($Na_2SnO_3$) added was changed to 267 g.

Preparation of Undercoat Layer-Forming Coating Liquid 5

An undercoat layer-forming coating liquid 5 was obtained as with the undercoat layer-forming coating liquid 3 except that, in the method of preparing the undercoat layer-forming coating liquid 3, the conductive particles 3 were changed to their base materials, titanium oxide particles (number-average particle size: 200 nm).

Preparation of Undercoat Layer-Forming Coating Liquid 6

An undercoat layer-forming coating liquid 6 was obtained as with the undercoat layer-forming coating liquid 3 except that, in the method of preparing the undercoat layer-forming coating liquid 3, the conductive particles 3 were changed to tin oxide particles (number-average particle size: 30 nm) that were produced as with the titanium oxide particles except that titanium oxide particles were not used but tin oxide used for coating the titanium oxide particles was used.

Preparation of Undercoat Layer-Forming Coating Liquid 7

An undercoat layer-forming coating liquid 7 was obtained as with the undercoat layer-forming coating liquid 1 except that, in the method of preparing the undercoat layer-forming coating liquid 1, the amount of the conductive particles 1 added was changed to 54 parts.

Preparation of Undercoat Layer-Forming Coating Liquid 8

An undercoat layer-forming coating liquid 8 was obtained as with the undercoat layer-forming coating liquid 1 except that, in the method of preparing the undercoat layer-forming coating liquid 1, the amount of the conductive particles 1 added was changed to 108 parts.

Preparation of Undercoat Layer-Forming Coating Liquid 9

An undercoat layer-forming coating liquid 9 was obtained as with the undercoat layer-forming coating liquid 1 except that, in the method of preparing the undercoat layer-forming coating liquid 1, the amount of the conductive particles 1 added was changed to 113 parts.

Preparation of Undercoat Layer-Forming Coating Liquid 10

An undercoat layer-forming coating liquid 10 was obtained as with the undercoat layer-forming coating liquid 3 except that, in the method of preparing the undercoat layer-forming coating liquid 3, the amount of aluminum oxide added was changed to 5 mol % relative to Sn.

Preparation of Undercoat Layer-Forming Coating Liquid 11

An undercoat layer-forming coating liquid 11 was obtained as with the undercoat layer-forming coating liquid 3 except that, in the method of preparing the undercoat layer-forming coating liquid 3, aluminum oxide was not added.

Preparation of Undercoat Layer-Forming Coating Liquid 16

An undercoat layer-forming coating liquid 16 was obtained as with the undercoat layer-forming coating liquid 3 except that, in the method of preparing the undercoat layer-forming coating liquid 3, the amount of the silicone resin particles added was changed to 15 parts.

Preparation of Undercoat Layer-Forming Coating Liquid 18

An undercoat layer-forming coating liquid 18 was obtained as with the undercoat layer-forming coating liquid 3 except that, in the method of preparing the undercoat layer-forming coating liquid 3, the number-average particle size of primary particles of the titanium oxide particles was changed to 320 nm.

Preparation of Undercoat Layer-Forming Coating Liquid 19

An undercoat layer-forming coating liquid 19 was obtained as with the undercoat layer-forming coating liquid 3 except that, in the method of preparing the undercoat layer-forming coating liquid 3, the titanium oxide particles were changed to aluminum oxide particles (number-average particle size of primary particles: 220 nm).

Preparation of Undercoat Layer-Forming Coating Liquid 20

An undercoat layer-forming coating liquid 20 was obtained as with the undercoat layer-forming coating liquid 3 except that, in the method of preparing the undercoat layer-forming coating liquid 3, the amount of aluminum oxide added was changed to 12 mol % relative to Sn.

Preparation of Undercoat Layer-Forming Coating Liquid 103

An undercoat layer-forming coating liquid 103 was obtained as with the undercoat layer-forming coating liquid 3 except that, in the method of preparing the undercoat layer-forming coating liquid 3, the amount of the silicone resin particles added was changed to 8 parts.

Production of Electrophotographic Photosensitive Members

Production of Electrophotographic Photosensitive Member 1

As a support, an aluminum cylinder (conductive support) having a diameter of 20 mm and a length of 260 mm was used.

The support was immersed into the undercoat layer-forming coating liquid 1 prepared above to form a coating film. The coating film was heated for 30 minutes at 150° C., so that the coating film was dried and cured. Thus, an undercoat layer having a thickness of 30 μm was formed.

Subsequently, 2 parts of polyvinyl butyral (trade name: S-LEC BX-1, manufactured by SEKISUI CHEMICAL CO., LTD.) was dissolved in 100 parts of cyclohexanone. To the resultant solution, 4 parts of hydroxygallium phthalocyanine crystals (charge generation material) that had a crystal form having peaks at 7.4° and 28.1° in Bragg angle 2θ±0.2° in a CuKα characteristic X-ray diffraction pattern and 0.04 parts of a compound represented by the following formula (A) were added.

(A)

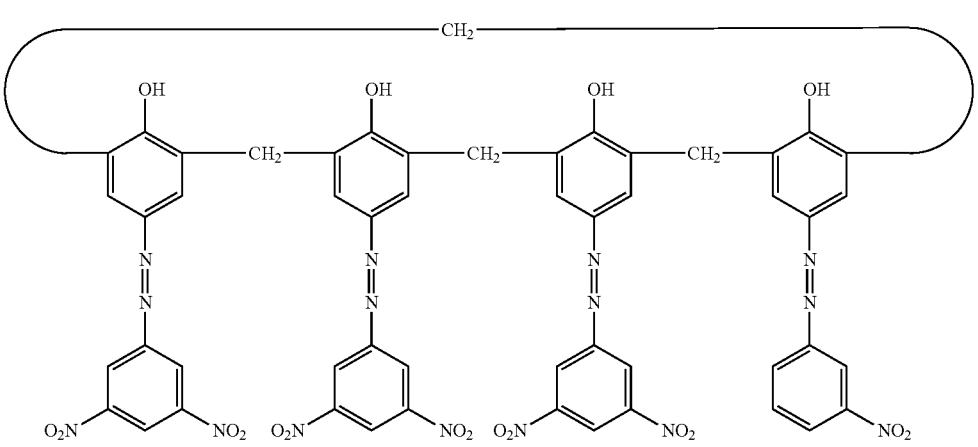

3 except that, in the method of preparing the undercoat layer-forming coating liquid 5, the titanium oxide particles were changed to aluminum oxide particles (number-average particle size of primary particles: 220 nm).

Preparation of Undercoat Layer-Forming Coating Liquid 101

An undercoat layer-forming coating liquid 101 was obtained as with the undercoat layer-forming coating liquid 1 except that, in the method of preparing the undercoat layer-forming coating liquid 1, the amount of the conductive particles 1 added was changed to 50 parts.

Preparation of Undercoat Layer-Forming Coating Liquid 102

An undercoat layer-forming coating liquid 102 was obtained as with the undercoat layer-forming coating liquid The resultant solution was placed in a sand mill using glass beads having a diameter of 1 mm and subjected to dispersion treatment in an atmosphere at 23±3° C. for 1 hour. After the dispersion treatment was performed, to the resultant dispersion liquid, 100 parts of ethyl acetate was added to thereby prepare a charge generation layer-forming coating liquid. This charge generation layer-forming coating liquid was used to perform immersion coating, so that a coating film was formed on the undercoat layer. The coating film was dried for 10 minutes at 90° C. Thus, a charge generation layer having a thickness of 0.20 μm was formed.

Subsequently, 50 parts of an amine compound represented by the following formula (B) (charge transport material (hole transport material)), (B)

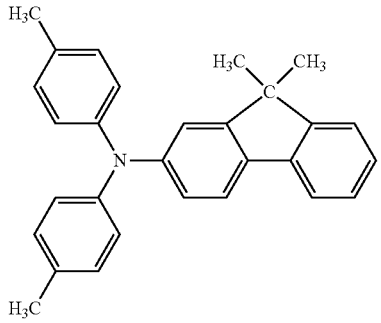

an amine compound (50 parts) represented by the following structural formula (C) (charge transport material (hole transport material)), and (C)

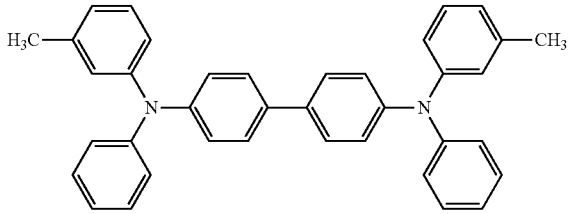

a polycarbonate (100 parts, trade name: Iupilon 2400, manufactured by MITSUBISHI GAS CHEMICAL COMPANY, INC.) were dissolved in a solvent mixture composed of 650 parts of chlorobenzene and 150 parts of dimethoxymethane, to thereby prepare a charge transport layer-forming coating liquid. This charge transport layer-forming coating liquid was left for one day. The resultant charge transport layer-forming coating liquid was used to perform immersion coating to form a coating film on the charge generation layer. The coating film was dried for 30 minutes at 110° C. Thus, a charge transport layer having a thickness of 21 μm was formed.

In this way, an electrophotographic photosensitive member 1 was formed. The volume resistivity of the undercoat layer was measured in the above-described manner. The electrophotographic photosensitive member 1 from which the layers on the undercoat layer had been removed was subjected to the measurement of the volume resistivity of the undercoat layer. The volume resistivity was found to be $2.3\times10^{13}$ Ω·cm.

Production of Electrophotographic Photosensitive Member 2

An electrophotographic photosensitive member 2 was produced as with the electrophotographic photosensitive member 1 except that an intermediate layer was formed on the undercoat layer of the electrophotographic photosensitive member 1 in the following manner.

Example compound A101 (8 parts), 10 parts of a blocked isocyanate resin (trade name: TPA-B80E, 80% solution, manufactured by Asahi Chemical Industry Co., Ltd.), 0.1 parts of zinc octylate(II), and 2 parts of a butyral resin (KS-5, manufactured by SEKISUI CHEMICAL CO., LTD.) were dissolved in a solvent mixture composed of 100 parts of dimethylacetamide and 100 parts of methyl ethyl ketone to prepare an intermediate layer-forming coating liquid. This intermediate layer-forming coating liquid was used to perform immersion coating to form a coating film on the undercoat layer. The coating film was heated for 30 minutes at 160° C., so that it was cured (polymerized). Thus, an intermediate layer having a thickness of 0.5 μm was formed.

The electrophotographic photosensitive member 2 from which the layers on the undercoat layer had been removed was subjected to the measurement of the volume resistivity of the undercoat layer. The volume resistivity was found to be the same as in the electrophotographic photosensitive member 1, $2.3\times10^{13}$ Ω·cm.

Production of Electrophotographic Photosensitive Member 3

An electrophotographic photosensitive member 3 was produced as with the electrophotographic photosensitive member 1 except that the undercoat layer-forming coating liquid 1 in the electrophotographic photosensitive member 1 was changed to the undercoat layer-forming coating liquid 3 to form the undercoat layer.

The electrophotographic photosensitive member 3 from which the layers on the undercoat layer had been removed was subjected to the measurement of the volume resistivity of the undercoat layer. The volume resistivity was found to be $1.2\times10^{13}$ Ω·cm.

Production of Electrophotographic Photosensitive Member 4

An electrophotographic photosensitive member 4 was produced as with the electrophotographic photosensitive member 1 except that the undercoat layer-forming coating liquid 3 in the electrophotographic photosensitive member 3 was changed to the undercoat layer-forming coating liquid 4 to form the undercoat layer.

The electrophotographic photosensitive member 4 from which the layers on the undercoat layer had been removed was subjected to the measurement of the volume resistivity of the undercoat layer. The volume resistivity was found to be $1.4\times10^{13}$ Ω·cm.

Production of Electrophotographic Photosensitive Member 5

An electrophotographic photosensitive member 5 was produced as with the electrophotographic photosensitive member 1 except that the undercoat layer-forming coating liquid 1 in the electrophotographic photosensitive member 1 was changed to the undercoat layer-forming coating liquid 5 to form the undercoat layer.

The electrophotographic photosensitive member 5 from which the layers on the undercoat layer had been removed was subjected to the measurement of the volume resistivity of the undercoat layer. The volume resistivity was found to be $6.5\times10^{12}$ Ω·cm.

Production of Electrophotographic Photosensitive Member 6

An electrophotographic photosensitive member 6 was produced as with the electrophotographic photosensitive member 1 except that, in the method of producing the electrophotographic photosensitive member 3, the undercoat layer-forming coating liquid 3 was changed to the undercoat layer-forming coating liquid 6 and the thickness of the undercoat layer was changed to 10 μm.

The electrophotographic photosensitive member 6 from which the layers on the undercoat layer had been removed was subjected to the measurement of the volume resistivity of the undercoat layer. The volume resistivity was found to be $5.1\times10^{13}$ Ω·cm.

Production of Electrophotographic Photosensitive Member 7

An electrophotographic photosensitive member 7 was produced as with the electrophotographic photosensitive member 1 except that, in the method of producing the electrophotographic photosensitive member 1, the undercoat layer-forming coating liquid 1 was changed to the undercoat layer-forming coating liquid 7 to form the undercoat layer.

The electrophotographic photosensitive member 7 from which the layers on the undercoat layer had been removed was subjected to the measurement of the volume resistivity of the undercoat layer. The volume resistivity was found to be $9.3\times10^{13}$ Ω·cm.

Production of Electrophotographic Photosensitive Member 8

An electrophotographic photosensitive member 8 was produced as with the electrophotographic photosensitive member 1 except that, in the method of producing the electrophotographic photosensitive member 1, the undercoat layer-forming coating liquid 1 was changed to the undercoat layer-forming coating liquid 8 to form the undercoat layer.

The electrophotographic photosensitive member 8 from which the layers on the undercoat layer had been removed was subjected to the measurement of the volume resistivity of the undercoat layer. The volume resistivity was found to be $1.3\times10^{11}$ Ω·cm.

Production of Electrophotographic Photosensitive Member 9

An electrophotographic photosensitive member 9 was produced as with the electrophotographic photosensitive member 1 except that, in the method of producing the electrophotographic photosensitive member 1, the undercoat layer-forming coating liquid 1 was changed to the undercoat layer-forming coating liquid 9 to form the undercoat layer.

The electrophotographic photosensitive member 9 from which the layers on the undercoat layer had been removed was subjected to the measurement of the volume resistivity of the undercoat layer. The volume resistivity was found to be $9.7\times10^{10}$ Ω·cm.

Production of Electrophotographic Photosensitive Member 10

An electrophotographic photosensitive member 10 was produced as with the electrophotographic photosensitive member 1 except that, in the method of producing the electrophotographic photosensitive member 2, the undercoat layer-forming coating liquid 2 was changed to the undercoat layer-forming coating liquid 10 to form the undercoat layer.

The electrophotographic photosensitive member 10 from which the layers on the undercoat layer had been removed was subjected to the measurement of the volume resistivity of the undercoat layer. The volume resistivity was found to be $4.5\times10^{10}$ Ω·cm.

Production of Electrophotographic Photosensitive Member 11

An electrophotographic photosensitive member 11 was produced as with the electrophotographic photosensitive member 1 except that, in the method of producing the electrophotographic photosensitive member 10, the undercoat layer-forming coating liquid 2 was changed to the undercoat layer-forming coating liquid 11 to form the undercoat layer.

The electrophotographic photosensitive member 11 from which the layers on the undercoat layer had been removed was subjected to the measurement of the volume resistivity of the undercoat layer. The volume resistivity was found to be $6.5\times10^{9}$ Ω·cm.

Production of Electrophotographic Photosensitive Member 12

An electrophotographic photosensitive member 12 was produced as with the electrophotographic photosensitive member 11 except that the intermediate layer was formed in the following manner.

N-methoxymethylated nylon (4.5 parts, trade name: TORESIN EF-30T, manufactured by Nagase ChemteX Corporation) and 1.5 parts of a nylon copolymer resin (trade name: Amilan CM8000, manufactured by Toray Industries, Inc.) were dissolved in a solvent mixture composed of 65 parts of methanol and 30 parts of n-butanol to thereby prepare an intermediate layer-forming coating liquid. This intermediate layer-forming coating liquid was used to perform immersion coating to form a coating film on the undercoat layer. The coating film was dried for 6 minutes at 70° C. Thus, an undercoat layer having a thickness of 0.85 μm was formed.

The electrophotographic photosensitive member 12 from which the layers on the undercoat layer had been removed was subjected to the measurement of the volume resistivity of the undercoat layer. The volume resistivity was found to be the same as in the electrophotographic photosensitive member 11, $6.5\times10^{9}$ Ω·cm.

Production of Electrophotographic Photosensitive Member 13

An electrophotographic photosensitive member 13 was produced as with the electrophotographic photosensitive member 1 except that, in the method of producing the electrophotographic photosensitive member 1, the thickness of the undercoat layer was changed to 8 μm.

The electrophotographic photosensitive member 13 from which the layers on the undercoat layer had been removed was subjected to the measurement of the volume resistivity of the undercoat layer. The volume resistivity was found to be $2.4\times10^{13}$ Ω·cm.

Production of Electrophotographic Photosensitive Member 14

An electrophotographic photosensitive member 14 was produced as with the electrophotographic photosensitive member 1 except that, in the method of producing the electrophotographic photosensitive member 1, the thickness of the undercoat layer was changed to 10 μm.

The electrophotographic photosensitive member 14 from which the layers on the undercoat layer had been removed was subjected to the measurement of the volume resistivity of the undercoat layer. The volume resistivity was found to be $2.2\times10^{13}$ Ω·cm.

Production of Electrophotographic Photosensitive Member 15

An electrophotographic photosensitive member 15 was produced as with the electrophotographic photosensitive member 1 except that, in the method of producing the electrophotographic photosensitive member 1, the thickness of the undercoat layer was changed to 40 μm.

The electrophotographic photosensitive member 15 from which the layers on the undercoat layer had been removed was subjected to the measurement of the volume resistivity of the undercoat layer. The volume resistivity was found to be $1.8\times10^{13}$ Ω·cm.

Production of Electrophotographic Photosensitive Member 16

An electrophotographic photosensitive member 16 was produced as with the electrophotographic photosensitive member 11 except that, in the method of producing the electrophotographic photosensitive member 11, the undercoat layer-forming coating liquid 11 was changed to the undercoat layer-forming coating liquid 16 to form the undercoat layer.

The electrophotographic photosensitive member 16 from which the layers on the undercoat layer had been removed was subjected to the measurement of the volume resistivity of the undercoat layer. The volume resistivity was found to be $1.2\times10^{7}$ Ω·cm.

Production of Electrophotographic Photosensitive Member 17

An electrophotographic photosensitive member 17 was produced as with the electrophotographic photosensitive member 1 except that, in the method of producing the electrophotographic photosensitive member 1, the diameter of the aluminum cylinder was changed to 24 mm.

The electrophotographic photosensitive member 17 from which the layers on the undercoat layer had been removed was subjected to the measurement of the volume resistivity of the undercoat layer. The volume resistivity was found to be $2.3\times10^{13}$ Ω·cm.

Production of Electrophotographic Photosensitive Member 18

An electrophotographic photosensitive member 18 was produced as with the electrophotographic photosensitive member 3 except that, in the method of producing the electrophotographic photosensitive member 3, the undercoat layer-forming coating liquid 3 was changed to the undercoat layer-forming coating liquid 18 to form the undercoat layer.

The electrophotographic photosensitive member 18 from which the layers on the undercoat layer had been removed was subjected to the measurement of the volume resistivity of the undercoat layer. The volume resistivity was found to be $1.7\times10^{13}$ Ω·cm.

Production of Electrophotographic Photosensitive Member 19

An electrophotographic photosensitive member 19 was produced as with the electrophotographic photosensitive member 3 except that, in the method of producing the electrophotographic photosensitive member 3, the undercoat layer-forming coating liquid 3 was changed to the undercoat layer-forming coating liquid 19 to form the undercoat layer.

The electrophotographic photosensitive member 19 from which the layers on the undercoat layer had been removed was subjected to the measurement of the volume resistivity of the undercoat layer. The volume resistivity was found to be $8.8\times10^{12}$ Ω·cm.

Production of Electrophotographic Photosensitive Member 20

An electrophotographic photosensitive member 20 was produced as with the electrophotographic photosensitive member 3 except that, in the method of producing the electrophotographic photosensitive member 3, the undercoat layer-forming coating liquid 3 was changed to the undercoat layer-forming coating liquid 20 to form the undercoat layer.

The electrophotographic photosensitive member 20 from which the layers on the undercoat layer had been removed was subjected to the measurement of the volume resistivity of the undercoat layer. The volume resistivity was found to be $1.2\times10^{12}$ Ω·cm.

Production of Electrophotographic Photosensitive Member 21

An electrophotographic photosensitive member 21 was produced as with the electrophotographic photosensitive member 1 except that, in the method of producing the electrophotographic photosensitive member 1, the diameter of the aluminum cylinder was changed to 30 mm.

The electrophotographic photosensitive member 21 from which the layers on the undercoat layer had been removed was subjected to the measurement of the volume resistivity of the undercoat layer. The volume resistivity was found to be $2.2\times10^{13}$ Ω·cm.

Production of Electrophotographic Photosensitive Member 101

An electrophotographic photosensitive member 101 was produced as with the electrophotographic photosensitive member 1 except that, in the method of producing the electrophotographic photosensitive member 1, the undercoat layer-forming coating liquid 1 was changed to the undercoat layer-forming coating liquid 101 to form the undercoat layer.

The electrophotographic photosensitive member 101 from which the layers on the undercoat layer had been removed was subjected to the measurement of the volume resistivity of the undercoat layer. The volume resistivity was found to be $1.4\times10^{14}$ Ω·cm.

Production of Electrophotographic Photosensitive Member 102

An electrophotographic photosensitive member 102 was produced as with the electrophotographic photosensitive member 3 except that, in the method of producing the electrophotographic photosensitive member 3, the undercoat layer-forming coating liquid 3 was changed to the undercoat layer-forming coating liquid 102 to form the undercoat layer.

The electrophotographic photosensitive member 102 from which the layers on the undercoat layer had been removed was subjected to the measurement of the volume resistivity of the undercoat layer. The volume resistivity was found to be $1.7\times10^{14}$ Ω·cm.

Production of Electrophotographic Photosensitive Member 103

An electrophotographic photosensitive member 103 was produced as with the electrophotographic photosensitive member 16 except that, in the method of producing the electrophotographic photosensitive member 16, the undercoat layer-forming coating liquid 16 was changed to the undercoat layer-forming coating liquid 103 to form the undercoat layer.

The electrophotographic photosensitive member 103 from which the layers on the undercoat layer had been removed was subjected to the measurement of the volume resistivity of the undercoat layer. The volume resistivity was found to be $9.4\times10^{6}$ Ω·cm.

Production of Charging Roller

1. Preparation of Unvulcanized Rubber Composition

The predetermined amounts of materials described in Table 2 below were mixed to thereby prepare an unvulcanized rubber composition.

TABLE 2

| | |
|---|---|
| Epichlorohydrin-ethylene oxide-allyl glycidyl ether terpolymer (GECO) (trade name: EPICHLOMER CG-102, manufactured by DAISO CO., LTD.) | 100 parts by mass |
| Zinc oxide (zinc oxide II, manufactured by SEIDO CHEMICAL INDUSTRY CO., LTD.) | 5 parts by mass |
| Calcium carbonate (trade name: Silver-W, manufactured by SHIRAISHI CALCIUM KAISHA, LTD.) | 35 parts by mass |
| Carbon black (trade name: SEAST SO, manufactured by TOKAI CARBON CO., LTD.) | 0.5 parts by mass |
| Stearic acid | 2 parts by mass |
| Adipic acid ester (trade name: Polycizer W305ELS, manufactured by Dainippon Ink and Chemicals) | 10 parts by mass |
| Sulfur | 0.5 parts by mass |

TABLE 2-continued

| | |
|---|---|
| Dipentamethylenethiuram tetrasulfide (trade name: NOCCELER TRA, manufactured by OUCHI SHINKO CHEMICAL INDUSTRIAL CO., LTD.) | 2 parts by mass |
| Cetyltrimethylammonium bromide | 2 parts by mass |

2. Production of Conductive Elastic Roller

A round bar was prepared that had an overall length of 252 mm and an outer diameter of 6 mm and was produced by subjecting the surface of a free-machining steel bar to electroless nickel plating. Subsequently, an adhesive was applied to the whole circumferential surface of the round bar over a longitudinal region extending for 230 mm except for both end regions each having a length of 11 mm. The adhesive was a conductive hot-melt adhesive. The adhesive was applied with a roll coater. In this example, the adhesive-coated round bar was used as a conductive mandrel.

Subsequently, a crosshead extruder was prepared that had a conductive-mandrel feed mechanism and an unvulcanized-rubber-roller output mechanism. A die having an inner diameter of 12.5 mm was attached to the crosshead. The extruder and the crosshead were set at 80° C. The feed rate of the conductive mandrel was set to 60 mm/sec. Under these conditions, the unvulcanized rubber composition was supplied through the extruder so that, within the crosshead, the conductive mandrel was covered with an elastic layer formed of the unvulcanized rubber composition. Thus, an unvulcanized rubber roller was obtained. Subsequently, the unvulcanized rubber roller was placed into a hot air vulcanization oven at 170° C. and heated for 60 minutes to provide an unpolished conductive elastic roller. After that, the end portions of the elastic layer were cut and removed. Finally, the surface of the elastic layer was polished with a grindstone. The resultant conductive elastic roller had, in the middle portion, a diameter of 10.0 mm, and, at positions individually separated 90 mm from the middle portion toward the end portions, a diameter of 9.9 mm.

3. Production of Coating Liquid 1

A coating liquid containing a binder resin for forming the conductive layer of the charging roller was produced in the following manner.

In a nitrogen atmosphere, 100 parts of a polyester polyol (trade name: P2010 manufactured by KURARAY CO., LTD.) was gradually dropped to 27 parts of a polymeric MDI (trade name: Millionate MR200 manufactured by Nippon Polyurethane Industry Co., Ltd.) within a reaction vessel while the internal temperature of the reaction vessel was maintained to be 65° C. After the dropping was completed, the resultant mixture was caused to react at 65° C. for 2 hours. The resultant reaction mixture was cooled to room temperature. Thus, an isocyanate-terminated prepolymer 1 having an isocyanate group content of 4.3% was obtained.

Preparation of Coating Liquid 1

The isocyanate-terminated prepolymer 1 (54.9 parts), 41.52 parts of the above-described polyester polyol (trade name: P2010, manufactured by KURARAY CO., LTD.), and 15 parts of carbon black (TOKABLACK #7360SB, manufactured by TOKAI CARBON CO., LTD.) were mixed by stirring.

Subsequently, methyl ethyl ketone (hereafter MEK) was added such that the total solid content became 30% by mass. The resultant solution was mixed with a paint shaker for 12 hours. Furthermore, the resultant solution was adjusted with MEK so as to have a viscosity of 8 cps. Thus, a coating liquid 1 was prepared.

4. Production of Charging Roller

The conductive elastic roller produced in the "2. Production of conductive elastic roller" was dipped once in the coating liquid 1 produced in the manner described in the "3. Production of coating liquid 1". After that, the roller was air-dried at 23° C. for 30 minutes, subsequently dried in a hot air circulation dryer set at 90° C. for 1 hour, and further dried in a hot air circulation dryer set at 160° C. for 1 hour. Thus, a conductive layer was formed on the outer circumferential surface of the conductive elastic roller. The time for immersing the roller during dip coating was set to 9 seconds. For the withdrawal rate of the roller during dip coating, the initial rate was set to 20 mm/sec and the final rate was set to 2 mm/sec; and the rate was linearly changed with time from 20 mm/sec to 2 mm/sec. In this way, the charging roller was produced.

5. Evaluations for Characteristics

Conductive rollers obtained in the above-described manner were subjected to evaluation tests described below. The evaluation results are described in Table 3.

TABLE 3

| | Production example a | Production example b | Production example c | Production example d | Production example e |
|---|---|---|---|---|---|
| Surface layer CB amount | 12 | 15 | 18 | 23 | 28 |
| Resistivity (Ωcm) | $1.2 \times 10^9$ | $3.1 \times 10^8$ | $4.4 \times 10^7$ | $1.2 \times 10^7$ | $7.9 \times 10^6$ |
| Universal hardness ($N/mm^2$) | 1.2 | 1.5 | 1.8 | 2.3 | 4 |

5-1: Measurement of Volume Resistivity of Charging Roller

Figure 5:
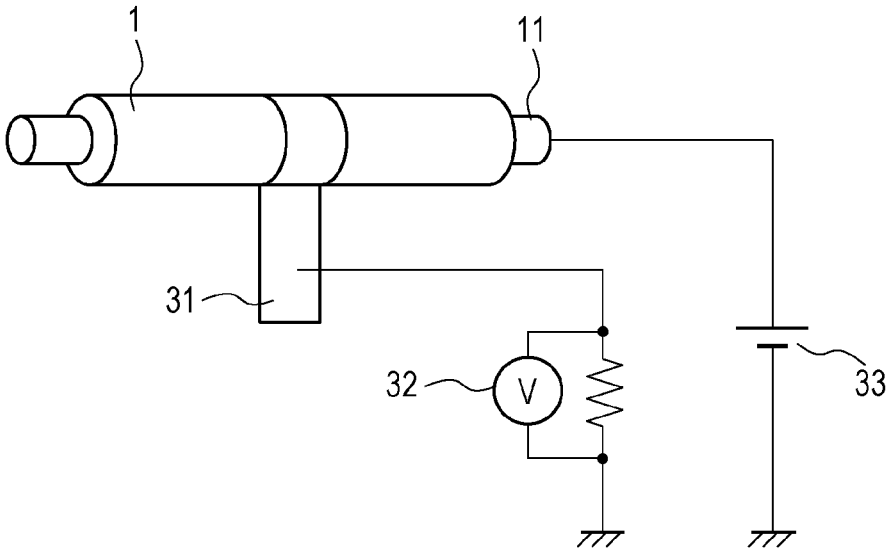
FIG. 5 is an explanatory view for a method of measuring the volume resistivity of a charging roller.

FIG. 5 is a schematic view of a resistance measurement instrument. An aluminum sheet 31 having a width of 1.5 cm is tightly wound around the middle portion of a charging roller 1 without a gap between the aluminum sheet and the charging roller. In this state, a direct current voltage was applied with a power supply 32 to a metal core portion 11 of the charging roller 1. On the basis of the voltage across a resistor 33 connected in series with the aluminum sheet 31, the electric resistance of the charging roller was measured. Specifically, the electric resistance of the charging roller was measured with the instrument in FIG. 5 while a direct current voltage of 200 V was applied between the metal core 11 and the aluminum sheet 31. On the basis of the measured electric resistance value (Ωd), with the roller outer diameter being 10 mm, the aluminum sheet width being 1.5 cm, and the charging roller thickness being 2.0 mm, a volume resistivity (Pd) was calculated with the following formula (4).

$$Pd=(\Omega d\times 1.0\times\pi\times 1.5)/0.20 \quad (4)$$

5-2: Measurement of Surface Hardness of Charging Roller

The surface hardness of the charging roller was measured with a universal hardness meter (trade name: microhardness measurement instrument H-100V, manufactured by Fisher). The indenter used for the measurement was a diamond having the shape of a quadrangular pyramid. The indentation rate is described with the following formula 5.

$$dF/dt=1000\ \text{mN}/240\ \text{s} \quad (5)$$

In the formula 5, F represents force and t represents time. The maximum hardness at the time when the indenter was at an indentation depth of 1 μm was determined as the surface hardness of the charging roller.

Examples 1 to 29, Comparative Examples 1 to 3, and Reference Examples 1 to 3

Evaluations were carried out for combinations of an electrophotographic photosensitive member and a charging roller described in Table 4. The results are also described in Table 4. The other items in Table 4, "Peripheral speed difference", "Amplitude of Vd", "Charging streaks", and "Spots" will be described below. The peripheral speed difference denotes the ratio (%) of the peripheral speed of the charging roller to the peripheral speed of the electrophotographic photosensitive member.

Evaluations

Evaluations in Terms of Amplitude of Dark-Area Potential (Vd), Charging Streaks, and Spots As the evaluation apparatus, a color laser beam printer (trade name: CP4525) manufactured by Hewlett-Packard Company was used. This evaluation apparatus was modified such that the cleaning blade of the drum cartridge was removed and the electrophotographic photosensitive member having an outer diameter of 20 mm was in contact with the charging roller. The evaluation apparatus was also modified such that the contact portions of the electrophotographic photosensitive member and the charging roller move in the same direction, and the electrophotographic photosensitive member and the charging roller were rotated with a peripheral speed difference therebetween.

The surface potential of the electrophotographic photosensitive member was measured in the following manner: a development cartridge was taken out from the evaluation apparatus; a potential probe (trade name: model 6000B-8, manufactured by TREK, INC.) was fixed to the development cartridge; and a surface electrometer (model 344: manufactured by TREK, INC.) was used for the measurement. For the potential measurement instrument, the potential measurement probe was disposed at the development position in the development cartridge; the position of the potential measurement probe relative to the electrophotographic photosensitive member was above the middle (in the axial direction) of the electrophotographic photosensitive member with a gap of 3 mm from the surface of the electrophotographic photosensitive member. As a charging condition, a direct current bias was controlled such that the surface potential (dark-area potential) of the electrophotographic photosensitive member was 600 V on average. Exposure was carried out under an exposure condition of 0.4 $\mu J/cm^2$.

Hereafter, the evaluations will be described. Each electrophotographic photosensitive member was evaluated under the charging condition and the exposure condition that were initially set.

The evaluations were carried out at ordinary temperature and ordinary humidity. First, the amplitude of the dark-area potential (Vd) set to be 600 V on average was determined as noise. For charging streaks, a halftone image having a one-dot Keima pattern (similar to a knight-jump pattern) was output and evaluated with the following evaluation system:

A: no charging streaks are observed;

B: charging streaks are slightly observed;

C: charging streaks are observed; and

D: charging streaks are clearly observed.

For evaluations in terms of charging streaks, there is the following relationship: the smaller the amplitude of the dark-area potential (Vd), the better the ranking result in terms of charging streaks. This is specifically indicated in Table 4.

For spots probably due to the presence of residual toner, a solid white image was output and evaluation was carried out with the following evaluation system:

A: the solid white image has 0 spots with respect to the area corresponding to one turn of the electrophotographic photosensitive member;

B: the solid white image has 1 or more and 2 or less spots with respect to the area corresponding to one turn of the electrophotographic photosensitive member;

C: the solid white image has 3 or more and 4 or less spots with respect to the area corresponding to one turn of the electrophotographic photosensitive member; and D: the solid white image has 5 or more spots with respect to the area corresponding to one turn of the electrophotographic photosensitive member.

TABLE 4

| | Photosensitive member | Charging roller | Peripheral speed difference (charging roller/photosensitive member) | Amplitude of Vd | Charging streaks | Spots |
|---|---|---|---|---|---|---|
| Example 1 | 1 | a | 110% | 3 | B | A |
| Example 2 | 1 | b | 110% | 0 | A | A |
| Example 3 | 1 | c | 110% | 1 | A | A |
| Example 4 | 1 | d | 110% | 1 | A | A |
| Example 5 | 1 | e | 110% | 3 | A | A |
| Example 6 | 2 | c | 110% | 0 | A | A |
| Example 7 | 3 | a | 110% | 4 | B | A |
| Example 8 | 3 | b | 110% | 1 | A | A |
| Example 9 | 3 | c | 110% | 0 | A | A |
| Example 10 | 3 | d | 110% | 1 | A | A |
| Example 11 | 3 | e | 110% | 3 | A | A |
| Example 12 | 4 | c | 110% | 2 | A | A |
| Example 13 | 5 | c | 110% | 6 | B | A |
| Example 14 | 6 | c | 110% | 7 | B | A |
| Example 15 | 7 | c | 110% | 3 | A | A |
| Example 16 | 8 | c | 110% | 8 | B | A |
| Example 17 | 9 | c | 110% | 6 | B | A |
| Example 18 | 10 | c | 110% | 4 | B | A |
| Example 19 | 11 | c | 110% | 3 | B | A |
| Example 20 | 12 | c | 110% | 5 | B | A |
| Example 21 | 13 | c | 110% | 1 | A | A |
| Example 22 | 14 | c | 110% | 2 | A | A |

TABLE 4-continued

| | Photosensitive member | Charging roller | Peripheral speed difference (charging roller/photosensitive member) | Amplitude of Vd | Charging streaks | Spots |
|---|---|---|---|---|---|---|
| Example 23 | 15 | c | 110% | 1 | A | A |
| Example 24 | 16 | c | 110% | 7 | B | A |
| Example 25 | 17 | c | 110% | 4 | B | A |
| Example 26 | 18 | c | 110% | 1 | A | A |
| Example 27 | 19 | c | 110% | 2 | A | A |
| Example 28 | 20 | c | 110% | 2 | A | A |
| Example 29 | 21 | c | 110% | 4 | A | B |
| Comparative example 1 | 101 | a | 110% | 17 | C | A |
| Comparative example 2 | 102 | a | 110% | 18 | D | A |
| Comparative example 3 | 103 | a | 110% | 16 | D | A |
| Reference example 1 | 1 | a | 100% | 4 | A | D |
| Reference example 2 | 1 | a | 90% | 2 | A | C |
| Reference example 3 | 1 | a | −100% (rotations in opposite directions) | 7 | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242579, filed Nov. 28, 2014, which is hereby incorporated by reference herein in its entirety.

What is claimed is:

1. An electrophotographic apparatus comprising:

a cylindrical electrophotographic photosensitive member;

a charging roller that is disposed so as to be in contact with the electrophotographic photosensitive member and applies a direct current voltage to charge the electrophotographic photosensitive member;

a driving force transmission that transmits a driving force which causes rotation so that contact portions of the electrophotographic photosensitive member and the charging roller move in the same direction and a peripheral speed of the charging roller is higher than a peripheral speed of the electrophotographic photosensitive member; and a developing device that supplies a toner onto the electrophotographic photosensitive member to form a toner image, wherein the developing device is configured to collect a residual toner left on the electrophotographic photosensitive member after the toner image has been transferred onto a transfer material, the electrophotographic photosensitive member comprises a support, an undercoat layer on the support, and a photosensitive layer on the undercoat layer, the undercoat layer contains metal oxide particles, and a volume resistivity of the undercoat layer is from $1\times10^{7}$ Ω·cm to $1\times10^{14}$ Ω·cm.

2. The electrophotographic apparatus according to claim 1, wherein the electrophotographic apparatus does not comprise a cleaning blade.

3. The electrophotographic apparatus according to claim 1, wherein the volume resistivity of the undercoat layer is from $1\times10^{11}$ Ω·cm to $1\times10^{14}$ Ω·cm.

4. The electrophotographic apparatus according to claim 1, wherein a volume resistivity of the charging roller is from $1\times10^{6}$ Ω·cm to $1\times10^{9}$ Ω·cm.

5. The electrophotographic apparatus according to claim 1, wherein the metal oxide particles within the undercoat layer are particles containing at least one selected from the group consisting of zinc oxide, titanium oxide, and tin oxide.

6. The electrophotographic apparatus according to claim 1, wherein the metal oxide particles within the undercoat layer have a number-average particle size of 300 nm or less.

7. The electrophotographic apparatus according to claim 1, wherein an electrophotographic photosensitive member/charging roller ratio of an outer diameter of the electrophotographic photosensitive member to an outer diameter of the charging roller is 25/10 or less.

8. A process cartridge detachably attachable to a main body of an electrophotographic apparatus, the process cartridge comprising:

a cylindrical electrophotographic photosensitive member;

a charging roller that is disposed so as to be in contact with the electrophotographic photosensitive member and charges the electrophotographic photosensitive member; and a driving force transmission that transmits a driving force which causes rotation so that contact portions of the electrophotographic photosensitive member and the charging roller move in the same direction and a peripheral speed of the charging roller is higher than a peripheral speed of the electrophotographic photosensitive member, wherein the process cartridge does not comprise a cleaning blade, the electrophotographic photosensitive member comprises a support, an undercoat layer on the support, and a photosensitive layer on the undercoat layer, the undercoat layer contains metal oxide particles, and a volume resistivity of the undercoat layer is from $1\times10^{7}$ Ω·cm to $1\times10^{14}$ Ω·cm.

9. The process cartridge according to claim 8, further comprising a developing device that supplies a toner onto the electrophotographic photosensitive member to form a toner image and collects a residual toner left on the electrophotographic photosensitive member after the toner image has been transferred onto a transfer material.

10. The process cartridge according to claim 8, wherein the charging roller is configured to apply a direct current voltage alone to charge the electrophotographic photosensitive member.

11. The process cartridge according to claim 8, wherein the volume resistivity of the undercoat layer is from $1\times10^{11}$ Ω·cm to $1\times10^{14}$ Ω·cm.

12. The process cartridge according to claim 8, wherein a volume resistivity of the charging roller is from $1\times10^{6}$ Ω·cm to $1\times10^{9}$ Ω·cm.

13. The process cartridge according to claim 8, wherein the metal oxide particles within the undercoat layer are particles containing at least one selected from the group consisting of zinc oxide, titanium oxide, and tin oxide.

14. The process cartridge according to claim 8, wherein the metal oxide particles within the undercoat layer have a number-average particle size of 300 nm or less.

15. The process cartridge according to claim 8, wherein an electrophotographic photosensitive member/charging roller ratio of an outer diameter of the electrophotographic photosensitive member to an outer diameter of the charging roller is 25/10 or less.

16. An image forming method comprising:

a step of charging a cylindrical electrophotographic photosensitive member by applying a direct current voltage with a charging roller in contact with the electrophotographic photosensitive member, the electrophotographic photosensitive member comprising a support, an undercoat layer on the support, and a photosensitive layer on the undercoat layer, the undercoat layer containing metal oxide particles, and a volume resistivity of the undercoat layer being from $1\times10^{7}$ Ω·cm to $1\times10^{14}$ Ω·cm;

an electrostatic latent image-forming step of forming an electrostatic latent image on the charged electrophotographic photosensitive member;

a developing step of forming a toner image on the electrophotographic photosensitive member by developing the electrostatic latent image with a toner;

a transfer step of transferring the toner image formed on the electrophotographic photosensitive member onto a transfer material via an intermediate transfer body or without using an intermediate transfer body; and a step of transmitting a driving force which causes rotation so that contact portions of the electrophotographic photosensitive member and the charging roller move in the same direction and so as to generate a peripheral speed difference between the charging roller and the electrophotographic photosensitive member, wherein, in the developing step, a residual toner left on the electrophotographic photosensitive member is collected after the toner image has been transferred onto a transfer material.

* * * * *